US009402137B2

(12) United States Patent
Hsu et al.

(10) Patent No.: US 9,402,137 B2
(45) Date of Patent: Jul. 26, 2016

(54) SOUND TRANSDUCER WITH INTERDIGITATED FIRST AND SECOND SETS OF COMB FINGERS

(75) Inventors: Shu-Ting Hsu, Villach (AT); Alfons Dehe, Reutlingen (DE)

(73) Assignee: Infineon Technologies AG, Neubiberg (DE)

( * ) Notice: Subject to any disclaimer, the term of this patent is extended or adjusted under 35 U.S.C. 154(b) by 1117 days.

(21) Appl. No.: 13/295,749

(22) Filed: Nov. 14, 2011

(65) Prior Publication Data

US 2013/0121509 A1 May 16, 2013

(51) Int. Cl.

| | |
|---|---|
| ***H04R 1/00*** | (2006.01) |
| ***H04R 19/00*** | (2006.01) |
| ***H04R 1/02*** | (2006.01) |
| *H04R 9/04* | (2006.01) |

(52) U.S. Cl.

CPC ..... *H04R 19/005* (2013.01); *H04R 1/02* (2013.01); *H04R 9/048* (2013.01); *H04R 2201/003* (2013.01)

(58) Field of Classification Search

USPC ..... 381/190, 174, 399, 398, 176, 335

See application file for complete search history.

(56) References Cited

U.S. PATENT DOCUMENTS

| | | | | |
|---|---|---|---|---|
| 6,831,531 | B1 | 12/2004 | Giousouf et al. | |
| 8,755,556 | B2 * | 6/2014 | Cohen | B81B 3/0021 381/176 |
| 2007/0029899 | A1 | 2/2007 | Matsuzawa | |
| 2007/0103031 | A1 | 5/2007 | Toda | |
| 2008/0123242 | A1 * | 5/2008 | Zhou | H01G 5/011 361/290 |
| 2010/0124343 | A1 | 5/2010 | Zhang | |
| 2010/0284553 | A1 * | 11/2010 | Conti et al. | 381/174 |

FOREIGN PATENT DOCUMENTS

| | | | |
|---|---|---|---|
| CN | 1481612 | A | 3/2004 |
| DE | 100 13 673 | A1 | 10/2001 |
| WO | WO 2007/019194 | A2 | 2/2007 |
| WO | WO 2010/038229 | A2 | 4/2010 |

OTHER PUBLICATIONS

Neumann, J.J., Jr., et al., "CMOS-MEMS membrane for audio-frequency acoustic actuation," The 14th IEEE International Conference on Micro Electro Mechanical Systems, Jan. 21-25, 2001, pp. 236-239, Interlaken, Switzerland.

Schenk, H., et al., "A resonantly excited 2D-micro-scanning-mirror with large deflection," Sensors and Actuators A: Physical, vol. 89, No. 1-2, 2001, pp. 104-111, Elsevier Science B.V.

(Continued)

*Primary Examiner* — Amir Etesam

(74) *Attorney, Agent, or Firm* — Slater Matsil, LLP

(57) ABSTRACT

A sound transducer includes a substrate with a cavity with extending from a first surface of the substrate, a body at least partially covering the cavity and being connected to the substrate by at least one resilient hinge, a first set of comb fingers mounted to the substrate, and a second set of comb fingers mounted to the body. The first set of comb fingers and the second set of comb fingers are interdigitated and configured to create an electrostatic force driving the body in a direction perpendicular to the first surface of the substrate. The body and the at least one resilient hinge are configured for a resonant or a near-resonant excitation by the electrostatic force.

23 Claims, 18 Drawing Sheets

(56) References Cited

OTHER PUBLICATIONS

Diamond, B., et al., "Digital Sound Reconstruction Using Arrays of CMOS-MEMS Microspeakers," The 15th IEEE International Conference on Micro Electro Mechanical Systems, Jan. 20-24, 2002, pp. 292-295, Las Vegas, Nevada.

Carr, E.J., et al., "Large-Stroke Self-Aligned Vertical Comb Drive Actuators for Adaptive Optics Applications," Proceedings of SPIE, the International Society for Optical Engineering (UCRL-PROC-217426), vol. 6113, Jan. 23-25, 2006, 12 pages, San Jose, California.

Kanno, I., et al., "Piezoelectric Miroactuators Composed of PZT Thin Films on Si Substrates," ASME/JSME Joint Conference on Micromechanics for Information and Precision Equipment (MIPE 2006), Jun. 21-23, 2006, 4 pages, Santa Clara, California.

Drabe, C., "Ein resonanter Mikroaktuator zur optischen Weglängenmodulation," Dissertation, Electronic Publication, Fraunhofer Publica (Germany), 2006, 129 pages.

Martin, D., "Design, Fabrication, and Characterization of a MEMS Dual-Backplate Capacitive Microphone," Graduate School of the University of Florida, Dissertation, Aug. 2007, 250 pages.

* cited by examiner 4. sputter metal contact
f Mask: Pad
Dry etch contact pads

5. Deposite oxide
f Mask: Finger
Dry etch oxide 6. b Mask: Backside trench
Dry etch backside 7. Dry etch frontside
Wet etch oxide

SOUND TRANSDUCER WITH INTERDIGITATED FIRST AND SECOND SETS OF COMB FINGERS

BACKGROUND

Microspeakers are small sound transducers and some microspeakers may be manufactured using semiconductor technology, so that the various parts of the microspeaker are of a semiconductor material or a material that is suitable for a semiconductor-oriented manufacturing process. A microspeaker typically needs to generate high air volume displacement to gain significant sound pressure level.

For the actuation of a membrane of a microspeaker, several options exist. Some microspeaker devices utilize piezo-electric actuators or parallel-plate electro-static actuators. Another approach is to use an electrostatic comb drive structure in two planes (i.e., a first part of the comb drive structure is arranged in a first plane and a second part of the comb drive structure is arranged in a second plane) to actuate the membrane perpendicularly to the planes.

The design of a suitable digital microspeaker faces tradeoffs between high frequency and low power actuation. This tradeoff may be addressed in the mechanical design of the device, namely the membrane and spring. Efforts are being made to design actuators that are fast (high resonance frequency) and at the same time are flexible enough (low resonance frequency) to allow for high actuation at low power.

SUMMARY OF THE INVENTION

Embodiments of the present invention relate to a sound transducer and, in some embodiments to a sound transducer with interdigitated first and second sets of comb fingers. Some embodiments of the present invention relate to an array of sound transducers. Some embodiments of the present invention relate to a resonantly excitable sound transducer. Some embodiments of the present invention relate to a sound reproduction system. Some embodiments of the present invention relate to a method for operating a sound transducer. Some embodiments of the present invention relate to a method for manufacturing a sound transducer.

According to one aspect of the teachings disclosed herein, a sound transducer comprises a substrate, a body, a first set of comb fingers, and a second set of comb fingers. The substrate has a first surface and a second surface, the first surface defining a first plane. Furthermore, the substrate has a cavity with an interior peripheral edge, the cavity extending from the first surface. The body has an exterior peripheral edge. The body is parallel to the first plane and is at least partially covering the cavity. The body is connected to the substrate by at least one resilient hinge. The first set of comb fingers is mounted to the substrate and connected to a first electrical connection. The second set of comb fingers is mounted to the body and extends past the exterior peripheral edge of the body. The second set of comb fingers is connected to a second electrical connection that is isolated from the first connection. The first set of comb fingers and the second set of comb fingers are interdigitated and configured to create an electrostatic force driving the body in a direction perpendicular to the first plane. The body and the at least one resilient hinge are configured for a resonant or a near-resonant excitation by the electrostatic force.

According to another aspect of the teachings disclosed herein, an array of sound transducers comprises a substrate having a first surface and a second surface, the first surface defining a first plane. Each sound transducer comprises a body having an exterior peripheral edge. The body is parallel to the first plane and at least partially blocking one of a plurality of cavities in the substrate. The cavity has an interior peripheral edge and the body is connected to the substrate by the at least one resilient hinge. A first set of comb fingers is mounted to the substrate, the first set of comb fingers being connected to a first electrical connection. A second set of comb fingers is mounted to the body and extends past the exterior peripheral edge of the body, the second set of comb fingers being connected to a second electrical connection that is isolated from the first connection. The first set of comb fingers and the second set of comb fingers are interdigitated such that, as the body moves, the first set of comb fingers and the second set of comb fingers maintain a relative spacing. The first set of comb fingers and the second set of comb fingers are configured to create an electrostatic driving force in a direction perpendicular to the first plane. The body and the at least one resilient hinge are configured for a resonant or near-resonant excitation by the electrostatic force. The sound transducers are individually or group-wise controllable in a digital manner such that an overall sound signal of the array of sound transducers is composed from individual sound signals produced by the individually or group-wise controlled sound transducers.

According to another aspect of the teachings disclosed herein, a resonantly excitable sound transducer comprises a substrate, a mechanical resonator structure, and an interdigitated comb drive. The substrate has a first surface and a second surface, the first surface defining a first plane. The substrate has a cavity with an interior peripheral edge. The cavity extends from at least one of the first surface and the second surface. The mechanical resonator structure blocks the cavity at least partially. The mechanical resonator structure is connected to the substrate by the at least one resilient hinge and configured to cause a displacement of a fluid within the cavity substantially at a resonance frequency of the mechanical resonator structure. The interdigitated comb drive is arranged at a gap between the substrate and the mechanical resonator structure configured to create an electrostatic force to cause a resonant or near-resonant excitation of the mechanical resonator structure.

According to another aspect of the teachings disclosed herein, a sound reproduction system comprises an electrostatic sound transducer and a controller. The electrostatic sound transducer comprises a membrane structure and an electrode structure. The controller is configured to receive an input signal representing a sound to be reproduced and to generate a control signal for the electrostatic sound transducer. The controller is configured to generate a modulation signal on the basis of the input signal and to amplitude-modulate a carrier signal having a frequency substantially at the resonance frequency of the electrostatic sound transducer.

According to another aspect of the teachings disclosed herein, a method for operating a sound transducer comprises generating a carrier signal having a carrier signal frequency and amplitude-modulating the carrier signal with a control signal that is based on an input signal representing a sound signal to be transduced by the sound transducer. The amplitude-modulating produces an amplitude-modulated carrier signal. The method further comprises applying the amplitude-modulated carrier signal to an interdigitated comb drive of the sound transducer. The interdigitated comb drive is configured to cause a resonant or near-resonant excitation of a moveable body of the sound transducer to thereby displace a fluid adjacent to the moveable body in accordance with the amplitude-modulated carrier signal. The carrier signal frequency is substantially equal or close to a resonance frequency of the moveable body. During an operation of the sound transducer the amplitude-modulated carrier signal has a non-zero minimal amplitude such that the resonant or near-resonant excitation of the moveable body is maintained.

According to another aspect of the teachings disclosed herein, a method for manufacturing a sound transducer comprises providing a substrate having a first surface and a second surface. The first surface defines a first plane and defines a trench etch mask for at least one isolation trench. The method further comprises etching the at least one isolation trench using the trench etch mask and refilling the at least one isolation trench with an isolator material. Furthermore, the method comprises defining at least one etch mask for a body, at least one resilient hinge connecting the body to the substrate, a first set of comb fingers associated with the substrate, and a second set of comb fingers associated with the body. The first set of comb fingers is connected to a first electrical connection and the second set of comb fingers is connected to a second electrical connection that is isolated from the first connection by the at least one isolation trench. The method also comprises simultaneously etching the body, the resilient hinge, the first set of comb fingers, and the second set of comb fingers using the at least one etch mask so that the body is released from the substrate. The first set of comb fingers and the second set of comb finger are interdigitated. The body and the at least one resilient hinge are configured for a resonant or a near-resonant excitation.

BRIEF DESCRIPTION OF THE DRAWINGS

Embodiments of the present invention will be described in more detail using the accompanying figures, in which.

DETAILED DESCRIPTION OF ILLUSTRATIVE EMBODIMENTS

Before embodiments of the present invention will be described in detail, it is to be pointed out that the same or functionally equal elements are provided with the same reference numbers and that a repeated description of elements provided with the same reference numbers is omitted. Furthermore, some functionally equal elements may also be provided with similar reference numbers wherein the two last digits are equal. Hence, descriptions provided for elements with the same reference numbers or with similar reference numbers are mutually exchangeable, unless noted otherwise.

In the following description, a plurality of details are set forth to provide a more thorough explanation of embodiments of the present invention. However, it will be apparent to one skilled in the art that embodiments of the present invention may be practiced without these specific details. In other instances, well known structures and devices are shown in schematic cross-sectional views or top-views rather than in detail in order to avoid obscuring embodiments of the present invention. In addition, features of the different embodiments described hereinafter may be combined with other features of other embodiments, unless specifically noted otherwise.

As mentioned above, several options exist for the actuation of a membrane of a microspeaker, such as piezoelectric actuation, parallel-plate electrostatic actuation, and electrostatic actuation using a comb drive in which the membrane-side comb is arranged in another plane than the substrate-side comb (out-of-plane comb drive).

Figure 1:
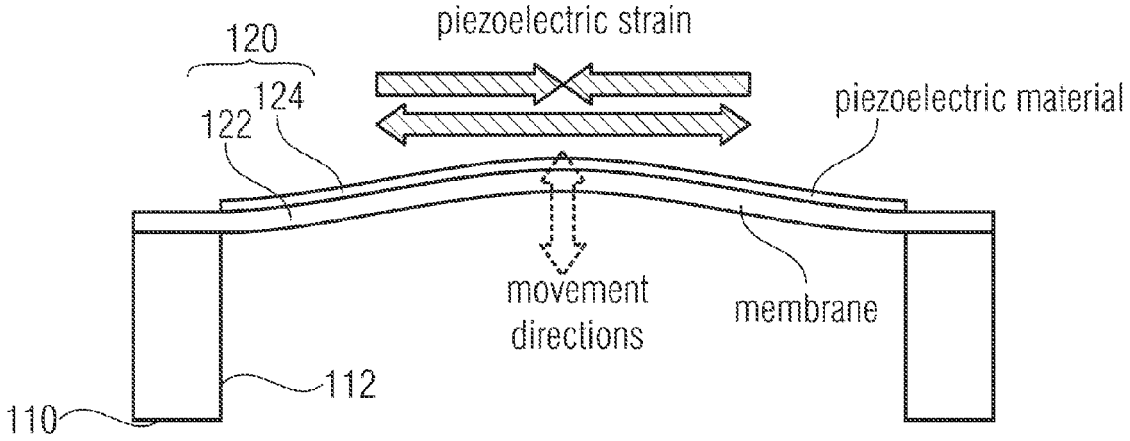
FIG. 1 shows a schematic cross section of a sound transducer utilizing a piezoelectric membrane actuation principle.

The first type of microspeaker design utilizes piezoelectric material for actuation. FIG. 1 shows a schematic cross section of a sound transducer utilizing a piezoelectric membrane actuation principle. The sound transducer shown in FIG. 1 comprises a substrate 110, a cavity 112 within the substrate 110, and a membrane structure 120. The membrane structure 120 comprises a pre-polarized piezoelectric film 124 and another structural film 122. The pre-polarized piezoelectric film 124 is deposited on the other structural film 122. The piezoelectric film 124 is connected to a first electrode (not shown). The other structural film 122 is connected to a second electrode (not shown). When an electrical potential difference is supplied between the electrodes, the piezoelectric film 124 contracts or expands causing the bi-morph membrane 120 to buckle and thus generates the vibration needed which occurs along the indicated movement directions.

The piezo-electric actuators require special materials such as PZT (lead zirconate titanate), zinc oxide (ZnO), aluminum nitride (AlN), PVDF (polyvinylidene fluoride) to produce the strain for deformation. Among them, PZT is not CMOS (Complementary Metal-Oxide-Semiconductor) compatible. PVDF is a spin-on polymer, but the piezo-electric property of the film 124 is affected by the following processes subsequent to the spin-on step. AlN and ZnO can be sputtered, but their piezo-electric constants are dependent on the alignment of the grains within the films. In the case of AlN, a high temperature epitaxial deposition produces the best results, but at the same time limits the freedom of design and process integration.

Figure 2:
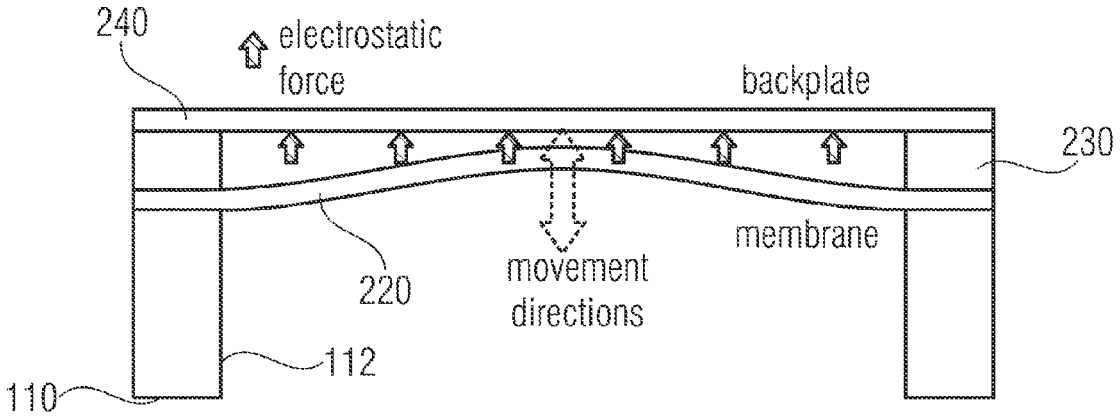
FIG. 2 shows a schematic cross section of a sound transducer utilizing a parallel-plate electrostatic membrane actuation principle.

A second type of microspeaker is schematically shown in FIG. 2 and comprises a movable membrane 220 and one back plate electrode 240. This configuration is typically called parallel-plate electrostatic actuator. The membrane 220 is separated from the backplate 240 by a spacer 230 having a thickness d which also defines the distance between the membrane 220 and the backplate 240 when the membrane is at a rest position. The membrane 220 is attracted to the electrode 240 when a potential difference is applied between them. An AC driving signal can induce the membrane 220 to vibrate back and forth. The displacement of parallel-plate electrostatic actuators is limited by the distance of the two electrodes, i.e., the membrane 220 and the electrode 240. This makes large displacements difficult to achieve with surface micro-machining processes. Besides, the force generated by the electrodes is inversely proportional to the square of the distance, adding to the difficulty in scaling up the displacement amplitude.

No matter what kind of actuation principle is used, a micro speaker arrangement may be utilized for digital sound reconstruction. For digital sound reconstruction an array of single speaker elements is typically driven at a high carrier frequency of at least twice the desired audio bandwidth. The individual elements have only discrete states to produce sound wavelets that form the final audio signal (low pass filtered in the human ear). For a digital microspeaker, it is desirable to have a relatively stiff membrane for high frequency and a large area to vibrate a large volume of air. This is difficult to achieve for a parallel plate device because the stress free membrane itself acts as a flexure, with which the resonant frequency is inversely related to $r^3$, where r is the diameter of the membrane. The same argument can be applied to piezo-electrically actuated devices.

The teachings disclosed herein disclose how to vibrate a volume with frequency between 50 Hz and 200 kHz using a micro-machined comb drive actuator, e.g., in silicon technology. Several such speakers can be arranged in array constellation.

The force generated by a parallel plate actuator of area A is:

$$F_p = \varepsilon_0 \frac{A}{d^2} \cdot V^2.$$

The displacement at the center of the plate is:

$$\delta_{p\text{-}center} = \frac{3(1-\nu^2)r^4}{16Et^3} \cdot P.$$

The undamped vibration frequency is:

$$f = \frac{1}{2\pi}\sqrt{\frac{k}{m}} \Rightarrow f \propto \frac{t}{r^3}.$$

In the above equations, $\in_0$ is the vacuum permittivity,

A is the active area of the parallel plate actuator,

D is the distance between the membrane 220 and the backplate 240,

V is the voltage applied between the membrane 220 and the backplate 240, ν is the Poisson's ratio of the membrane, E is the Young's modulus of the membrane, P is the pressure on the membrane, t is the thickness of the membrane, r is the radius of the membrane, k is the spring constant of the oscillating system which comprises the membrane, and m is the equivalent mass of the oscillating system which comprises the membrane.

The problem can be solved by using a very thick membrane to provide the necessary stiffness to achieve high frequency. However, thick membranes with large distance between two plates would increase the process complexity substantially and still would not provide the large deflection desirable for large amplitude actuations, especially in the case of a parallel-plate actuation principle.

A similar trade-off can be observed in the case of membranes under high tensile stress.

An alternative approach using an electrostatic comb drive structure was already mentioned above. Such a structure is able to work at frequencies below its mechanical self resonance. Typically, the comb drive comprises a fixed part and a mobile part wherein the mobile part is parallel to the fixed part but out-of-plane with respect to the fixed part. In other words, the fixed part is arranged in a first plane and the mobile part is arranged in a second plane parallel to the first plane. In this manner, an electrostatic force of attraction can be generated between the fixed part and the mobile part causing the mobile part to approach the fixed part. However, such out-of-plane comb drive structure is quite difficult to fabricate.

Figure 3:
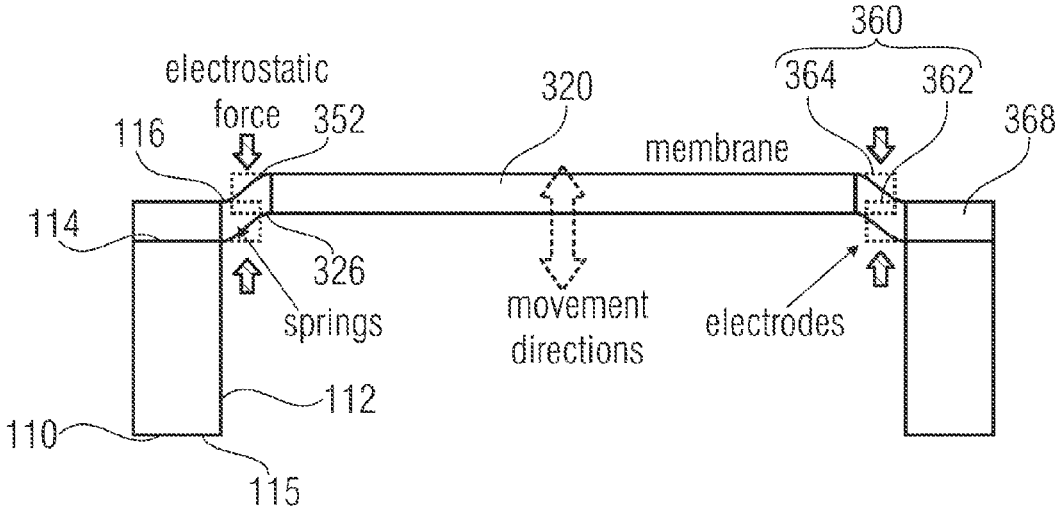
FIG. 3 shows a schematic cross section of a sound transducer utilizing an electrostatic comb drive for membrane actuation.

According to the teachings disclosed herein and as illustrated in FIG. 3, an interdigitated comb-drive actuator is used to drive the piston movement. The piston movement produces pressure resulting in an acoustic wave.

The sound transducer shown in FIG. 3 comprises a substrate 110, a comb drive structure 360, a membrane 320, and a plurality of springs 352. A cavity 112 is formed in the substrate and extends from a first surface 114 to a second surface 115 of the substrate 110. The comb drive 360 may be an out-of-plane comb drive and comprises a first set of comb fingers 362 mounted to the substrate 110 and a second set of comb fingers 364 mounted to the membrane 320. The first set of comb fingers 362 is mounted to the substrate 110 via a support structure 368 (e.g., as a frame), which is arranged on the first surface 114.

The cavity 112 is delimited by an interior peripheral edge 116 of the support structure 368. The membrane 320 is formed by a body having an exterior peripheral edge 326. The body 320 covers the cavity 112 at least partially and is connected to the substrate by at least one resilient hinge or a plurality of resilient hinges which are formed by the springs 352 in the configuration shown in FIG. 3.

The first set of comb fingers 362 is connected to a first electrical connection (not shown). The second set of comb fingers 364 extends past the exterior edge of the body 320 and is electrically connected to a second electrical connection (not shown) that is isolated from the first electrical connection. The first set of comb fingers 362 and the second set of comb fingers 364 are interdigitated and configured to create an electrostatic force driving the body 320 in a direction perpendicular to the first plane 114. FIG. 3 shows the comb drive 360 in an intermediate position where the first set of comb fingers 362 and the second set of comb fingers 364 overlap partly.

The body 320 and the resilient hinges 352 are configured for a resonant or near-resonant excitation by the electrostatic force. The body 320 and the resilient hinges 352 form a resonating system. A resonance frequency of the resonating system is defined by an equivalent mass and a spring constant. The equivalent mass is not only determined by the mass of the body 320, but also by a mass of a volume of air (or, more generally, a fluid) surrounding the body 320 and being driven by the body 320. The electrostatic force created by the first set of comb fingers 362 and the second set of comb fingers 364 varies with a frequency that is a function of the resonance frequency, e.g., approximately the resonance frequency. In the resonance case the displacement of the resonating system typically has a 90 degree phase difference with respect to the electrostatic force(s).

Figure 4:
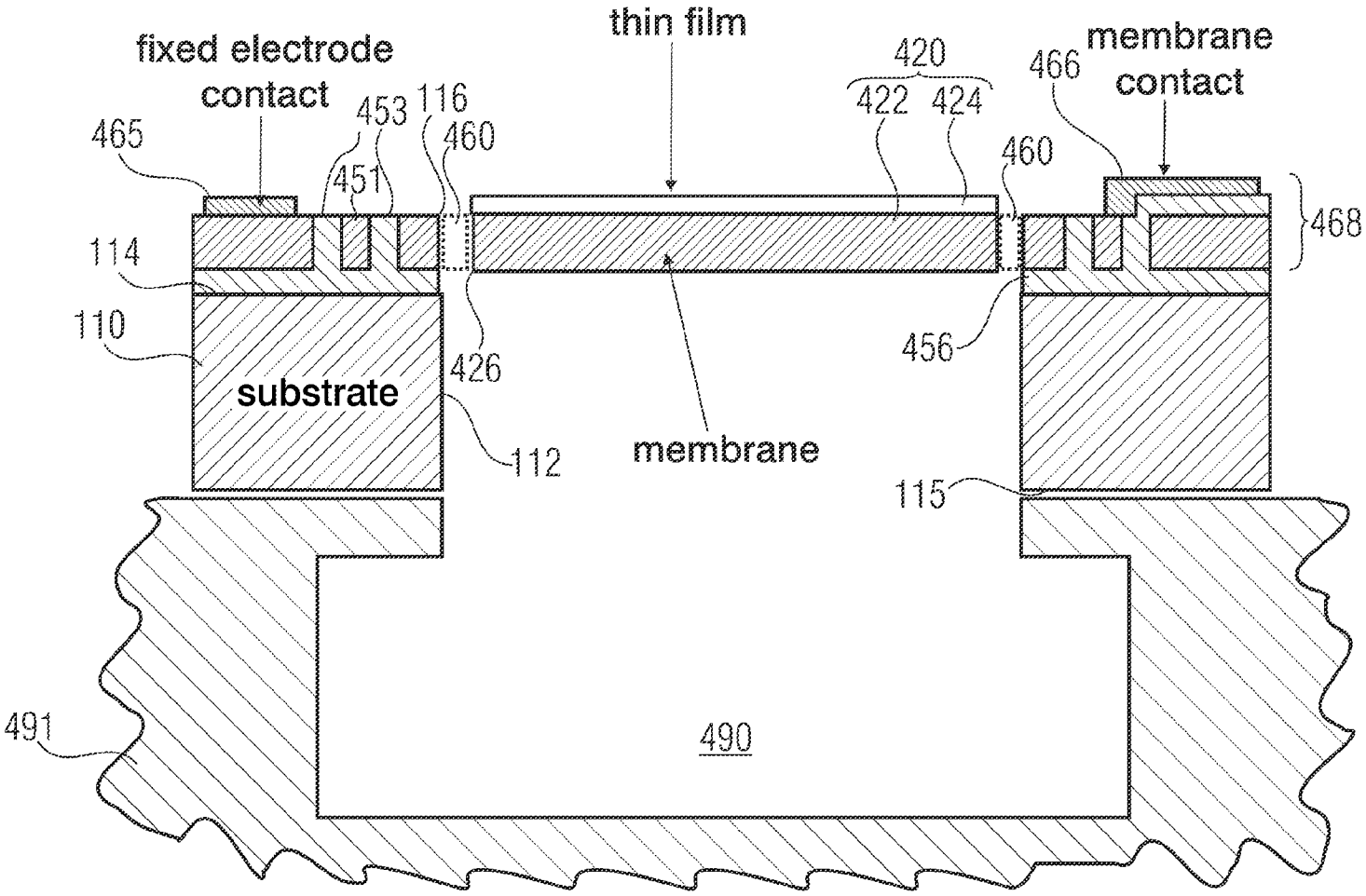
FIG. 4 shows a schematic cross section of a sound transducer according to an embodiment of the teachings disclosed herein.

FIG. 4 shows another embodiment of a sound transducer according to the teachings disclosed herein in a schematic cross section. The sound transducer comprises a membrane structure (or body) 420 which comprises a membrane material 422 and a thin film 424. The membrane structure 420 also comprises a peripheral edge 426. The sound transducer further comprises an in-plane comb drive 460 the position of which is schematically indicated in FIG. 3. Not explicitly shown in FIG. 4 are the first set of comb fingers 462 and the second set of comb fingers 464 and reference is made to FIG. 5 which shows the interdigitated comb drive 460 and the first and second sets of comb fingers 462, 464.

The support structure 468 is arranged on an isolating layer 456 which isolates the support structure 468 against the substrate 110. The support structure 468 comprises the fixed electrode contact (first electrical connection) 465, the membrane contact (second electrical connection) 466, a membrane conductor 451 and isolating trenches 453. The membrane contact 466 is connected to the membrane conductor 451 to connect the second set of comb fingers 464 with an electrical potential provided by a controller (not shown) so that in cooperation with another electrical potential applied to the first set of comb fingers 462 the electrostatic force between the first and second sets of comb fingers may be generated.

According to the teachings disclosed herein, the microspeaker membrane 420 is actuated by in-plane interdigitated electrodes of the comb drive 460 to perform a piston movement near a mechanical resonance frequency of the resonating system comprising the membrane 420. The actuation amplitude of the membrane 420 is not limited by the gap between electrodes. The electrodes 462, 464 can be fabricated within a single lithography and etch step and are constructed with CMOS compatible material or materials. Only little asymmetry is sufficient to start the actuation.

When the membrane 420 is at a rest position, the first set of comb fingers 462 and the second set of comb fingers 464 are substantially at a minimum distance from each other, or at least close to such a minimum distance. Therefore, creating an electrostatic, attractive force between the first set of comb fingers 462 and the second set of comb fingers 464 does not lead to a movement at all, or to a very small movement, only, because the first set of comb fingers 462 and the second set of comb fingers 464 cannot get any closer anymore (similar to a dead center in a reciprocating machine). This is particularly true if the first set of comb fingers 462 and the second set of comb fingers 464 are substantially symmetrically positioned with respect to each other when the membrane 420 is at the rest position, as the electrostatic force then acts in a direction substantially perpendicular to the movement direction(s) of the membrane. However, a real sound transducer typically exhibits some degree of asymmetry so that the electrostatic force comprises a component that is parallel to the movement direction(s). The asymmetry may be caused by manufacturing tolerances or external influences, such as the gravity acting on the membrane 420.

The interdigital comb drive structure 460 is fabricated as an in-plane structure and can be actuated close to self resonance. Only little initial displacement of the movable comb 464 against the stator comb 462 is sufficient to start the actuation. Such displacements can be generated by initial bending or slight fabrication induced asymmetry of the comb structure 460.

Due to the in-plane comb drive structure, the membrane movement is piston-like and allows for a large displacement. The movement range is not limited by the distance between the electrodes, and the electro-static force can be increased with the number of the electrodes and a reduced distance between the counter electrodes. The springs can be designed to different stiffness to accommodate different frequency requirements, without affecting the membrane size and/thickness. Furthermore, there is no parallel electrode that is limiting the movement by air flow damping.

The spring supported membrane 420 is comprised of CMOS compatible materials including polycrystalline silicon (poly-Si), amorphous silicon, silicon oxide ($SiO_2$), silicon nitride ($Si_3N_4$), aluminum or bulk silicon (bulk Si) with any combination of the above film stack. The thickness of the membrane 420 can range from 1 μm to 100 μm. The flexures (e.g., the elastic hinges 452, see FIG. 5) are comprised of bulk Si or bulk Si and other thin film materials as mentioned above. In particular, the thin film 424 may have an intrinsic stress that is different from an intrinsic stress within the membrane material 422. This difference of the intrinsic stresses typically leads to the membrane structure 420 bending or bulging in one direction, for example, away from the cavity 112 or into the cavity 112. In this manner, an asymmetry may be introduced deliberately for the rest position of the membrane structure 420 so that the membrane structure may be put into motion in a defined manner when starting from the rest position, as opposed to a (nearly) symmetric rest position, from which the membrane structure can hardly be put into motion because the attractive force between the first and second sets of comb fingers has substantially no component in the direction of movement of the membrane structure 420 (i.e., perpendicular to the main surface of the membrane).

The actuator at least to some embodiments of the teachings disclosed herein is constructed with two sets of interdigitated electrodes 462, 464 with a small intentional vertical displacement between the electrodes. As mentioned above, this can be achieved by pre-stressing the membrane with a thin film of $SiO_2$, $Si_3N_4$, aluminum, polyimide or a combination of the above materials. The intrinsic stress mismatch causes the membrane to have a curvature and thus creates a displacement between the two electrodes. The film of a material having an intrinsic stress different from an intrinsic stress of a body material and a hinge material may be located at or in at least one of the body and the at least one resilient hinge such that due to an intrinsic stress difference the first set of comb fingers and the second set of comb fingers are displaced with respect to each other in the direction perpendicular to the first plane. For example, when being at the rest position, the first set of comb fingers and the second set of comb fingers are offset with respect to each other in the direction perpendicular to the first plane by an offset less or equal to 10% of a maximum amplitude of an operative displacement of the body in the direction perpendicular to the first plane. The offset may even be smaller than 10% of the maximum amplitude of the operative displacement of the body, such as 8%, 6&, 5%, 4%, 3%, 2%, 1%, and below, as well as values in between the mentioned values.

Another option for deliberately introducing an asymmetry between the first and second sets of comb fingers when the membrane structure 320, 420 at the rest position, is to provide the first set of comb fingers and the second set of comb fingers with different extensions in the direction perpendicular to the first plane.

The electrodes 462, 464 are supplied with a potential difference with a frequency at or near its mechanical resonant frequencies. This creates an electro-static force to pull the electrodes together. If the force is large enough and the supplied voltage is near or at resonant frequency of the device, the membrane movement is amplified until counter balanced by damping. This creates a large displacement and thus a strong vibration of the air volume adjacent to the membrane.

The electro-static force generated from the actuator F is proportional to the number of sets of electrodes N, the square of the electrode overlap length $l^2$, and is inversely proportional to the square of the distance between a set of electrodes. This is true when the displacement is less than the electrode thickness t, where fringe effect is small. In the design proposed in this invention disclosure, the thickness of the electrodes can range from 5 μm to 70 μm, the gap between electrodes g may range between 2 μm to 10 μm, and the length of the electrodes is between 10 μm to 150 μm. With these quantities, the force generated by the interdigitated comb-drive actuator is given by the following equation:

$$F_c = \varepsilon_0 N \frac{l}{g} \cdot V^2.$$

The body 320, 420 and/or the at least one resilient hinge 352, 452 may be monolithically integrated with the substrate 110.

The body 320, 420 may have a lateral extension parallel to the first plane between 200 μm and 1000 μm, or between 400 μm and 800 μm, for example. The body 320, 420 may have a thickness in the direction perpendicular to the first plane between 5 μm and 70 μm, or between 10 μm and 50 μm, for example.

The body 320, 420 and the at least one resilient hinge 352, 452 may form a resonating structure. The first set of comb fingers 362, 462 and the second set of comb fingers 364, 464 may be configured to drive the resonating structure, during an operation of the sound transducer, in a substantially permanent resonant or near-resonant excitation, and to amplitude-modulate a resulting oscillation of the body 320, 420 at or near the resonant frequency of the resonating structure with a control signal that is based on an electrical input signal to be transduced by the sound transducer.

A part of the substrate 110 may be electrically isolated by means of at least one of a pn-junction, a buried oxide isolation layer, or a dielectric layer. The isolating layer 456 in FIG. 4 may be a buried oxide isolation layer or a dielectric layer.

The first set of comb fingers 362, 462 and the second set of comb fingers 364, 464 may maintain a minimum relative spacing as the body 320, 420 moves. The relative spacing refers to a distance between the first and second sets of comb fingers in a direction perpendicular to a direction of the main movement of the body. The fact that a minimum relative spacing is maintained means that the first and second sets of comb fingers do not get closer to each other than the mentioned minimum relative spacing during the movement of the body.

The body 320, 420 and the at least one resilient hinge 352, 452 may form a resonating structure having a resonating frequency between 40 kHz and 400 kHz, or between 60 kHz and 300 kHz, or between 80 kHz and 200 khz, for example.

The sound transducers illustrated in FIGS. 3 and 4 may be micro electrical mechanical systems (MEMSs) and may be manufactured using MEMS manufacturing technology. The self resonance is given by the mechanical properties of the MEMS structure, but also the surrounding package 491 can be used to support a resonance e.g., by air-spring/mass systems such as a Helmholtzian resonator or Helmholtz resonator 490. Such structures can be fabricated within bulk Si material and the process is fully CMOS compatible.

The sound transducers shown in FIGS. 3 and 4 may alternatively be described as having a substrate 110 with a first surface 114 and a second surface 115. The first surface defines a first plane. The substrate 110 has a cavity 112 with an interior peripheral edge 116. The cavity 112 extends from at least one of the first surface 114 and the second surface 115. The sound transducer further comprises a mechanical resonator structure that is at least partially blocking the cavity 112, the mechanical resonator structure being connected to the substrate 110 by at least one resilient hinge 352, 452 and configured to cause a displacement of a fluid within the cavity 112 substantially at a resonant frequency of the mechanical resonator structure. An interdigitated comb drive 360, 460 is arranged at a gap between the substrate 110 and the mechanical resonator structure and is configured to create an electrostatic force to cause a resonant or near-resonant excitation of the mechanical resonator structure.

Figure 5:
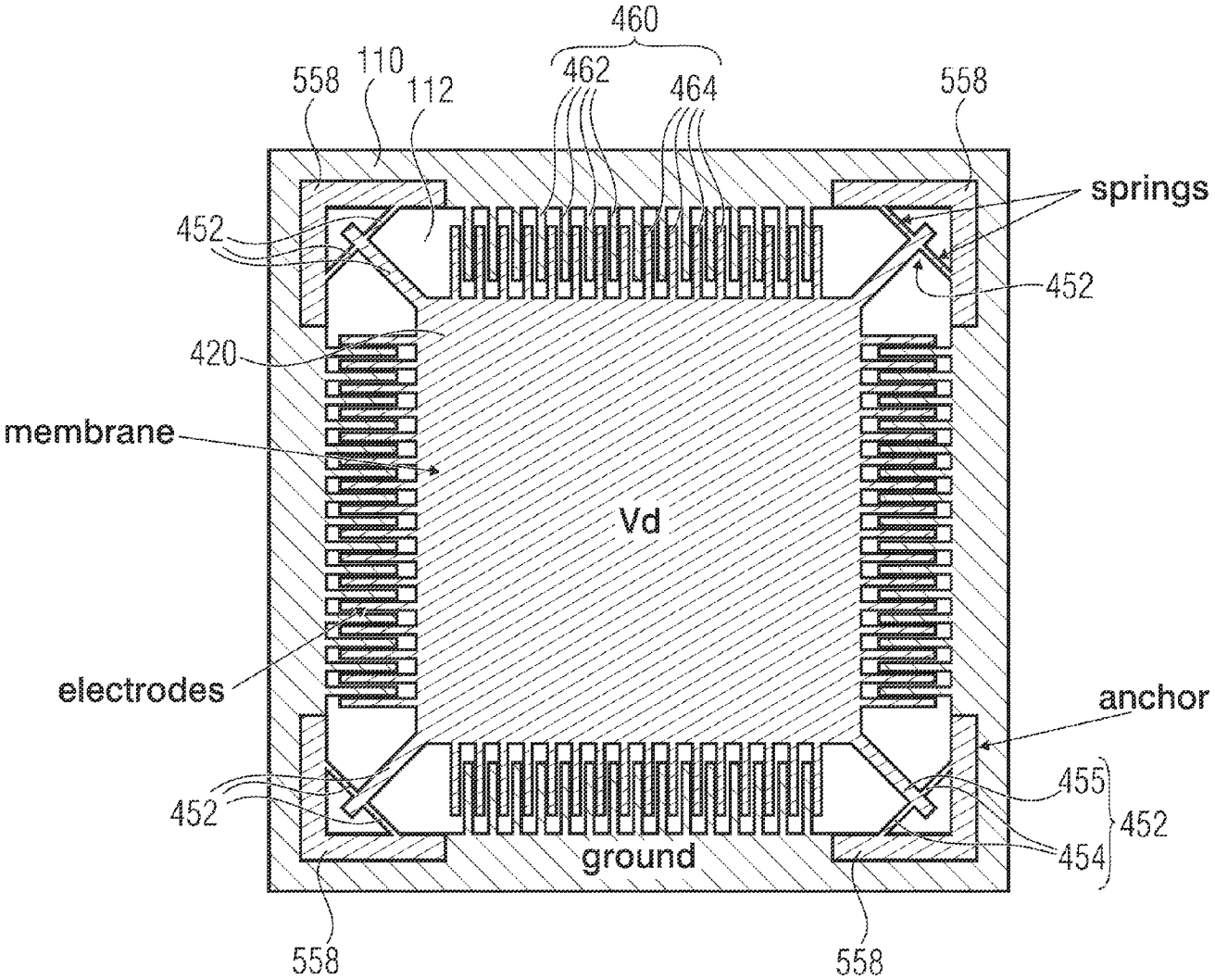
FIG. 5 shows a schematic top view of a sound transducer according to an embodiment of the teachings disclosed herein.

FIG. 5 shows a schematic top view of a sound transducer according to an embodiment of the teachings disclosed herein. The cavity 112 and the body 420 both have a substantially square shape and are congruent and concentric to each other. The sound transducer comprises a comb drive 460 which has four portions, one portion at each side of the square body 420. The first set of comb fingers 462 and the second set of comb fingers 464 can be seen in FIG. 5.

The sound transducer shown in FIG. 5 further comprises elastic hinges or springs 452. The elastic hinges 452 are arranged at the corners of the square shaped body 420. Each elastic hinge 452 connects one corner of the body 420 to an anchor 558 which is arranged in a corresponding corner of the cavity 112. Each hinge 452 comprises a pivot 454 and a strut 455. As the body 420 moves in the direction perpendicular to the drawing plane of FIG. 5, the pivot 454 performs a torsionally elastic movement which deflects the strut 455. In addition, the strut 455 may perform a translational deflection. This design of the elastic hinges 452 is capable of maintaining an alignment of the body 420 with respect to the substrate 110 so that a relative spacing of the first and second sets of comb fingers of the comb drive 460 is substantially maintained during the movement of the body 420.

The anchors 558 are L-shaped and may be used as electrically conducting elements in order to apply an electrical potential to the body 420 and thus to the second set of comb fingers 464 of the comb drive 460. In this case, the anchors 558 may be electrically isolated against the surrounding substrate 110.

Figure 6:
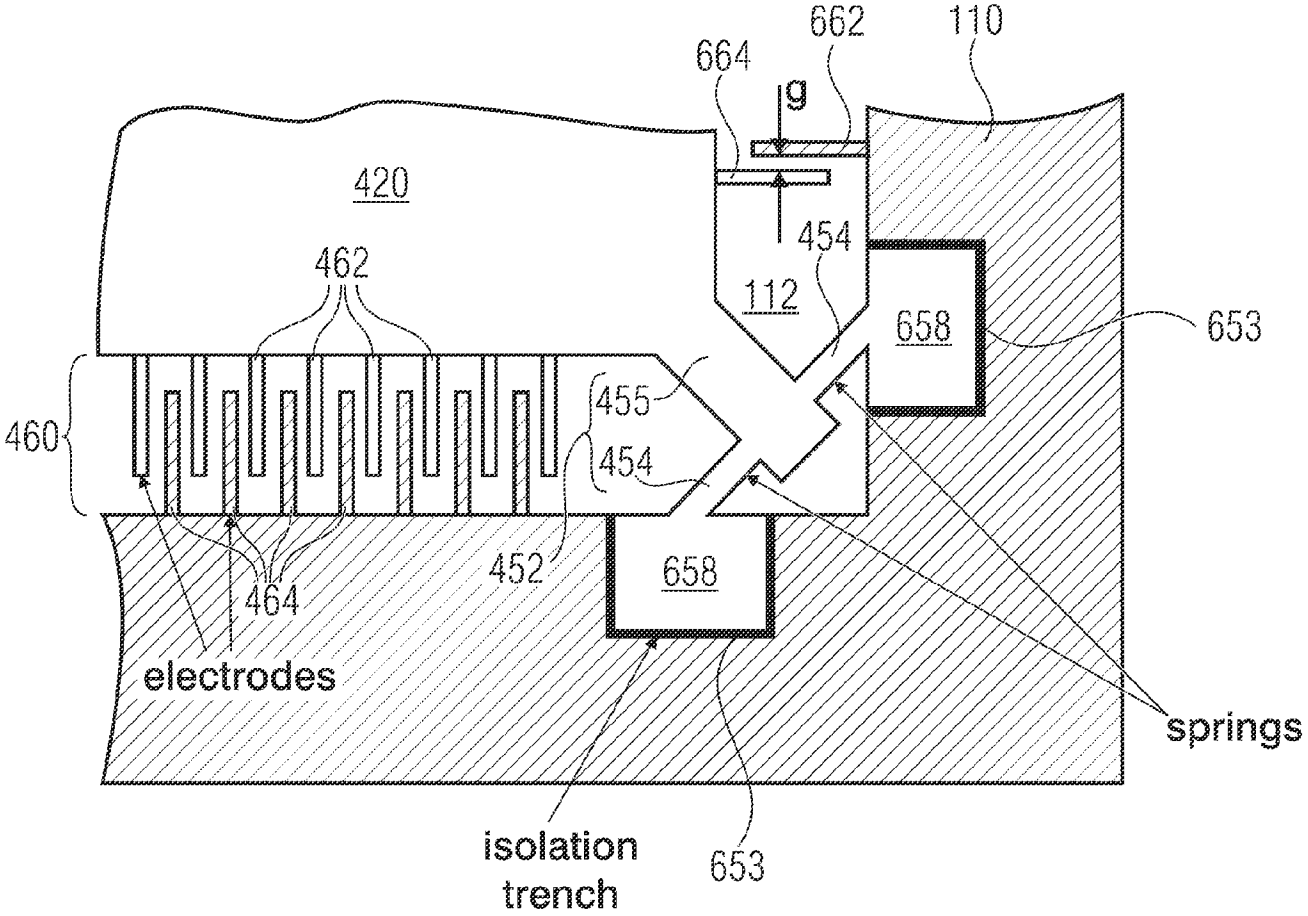
FIG. 6 shows a schematic top view of a detail of a sound transducer according to embodiments of the teachings disclosed herein.

FIG. 6 shows a schematic top view of a detail of a sound transducer according to embodiments of the teachings disclosed herein. In particular, an alternative anchor design is shown in FIG. 6 relative to the design shown in FIG. 5. Each elastic hinge 452 is connected to two anchor portions 658 which are individually isolated against the surrounding substrate by isolation trenches 653.

FIG. 6 also illustrates the gap g between one finger 662 of the first set of comb fingers 462 and one finger 664 of the second set of comb fingers 464. The gap g is also referred to as relative spacing of the first and second sets of comb fingers.

Figure 7A:
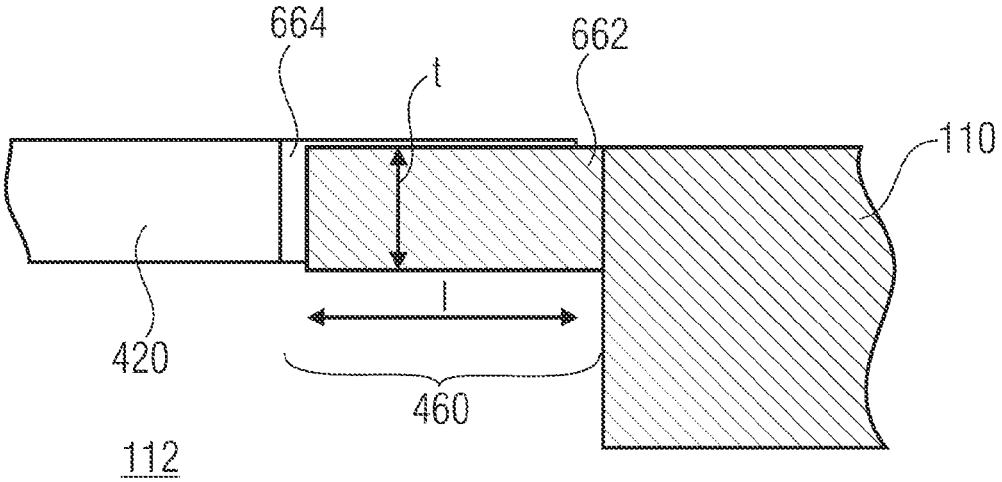
FIG. 7A shows a schematic cross section of a detail of a sound transducer according to embodiments of the teachings disclosed herein at a rest position.

FIG. 7A shows a schematic cross section of a detail of a sound transducer according to embodiments of the teachings disclosed herein at a rest position. In particular, the first finger 662 of the first set of comb fingers 462 and the second finger 664 of the second set of comb fingers 464 can be seen. The first finger 662 and the second finger 664 overlap by a length l. Both the first finger 662 and the second finger 664 have a thickness t in the direction of the movement of the body 420. The second finger 664 is slightly offset to the top (i.e., away from the cavity 112) with respect to the first finger 662. In this manner, an electrostatic force between the first finger 662 and second finger 664 causes the second finger 664 to be moved downwards so that the membrane 420 is accelerated in this direction by the electrostatic force. Due to attractive forces the membrane is displaced around the offset and because of the resonance the amplitude of the displacement is amplified.

Figure 7B:
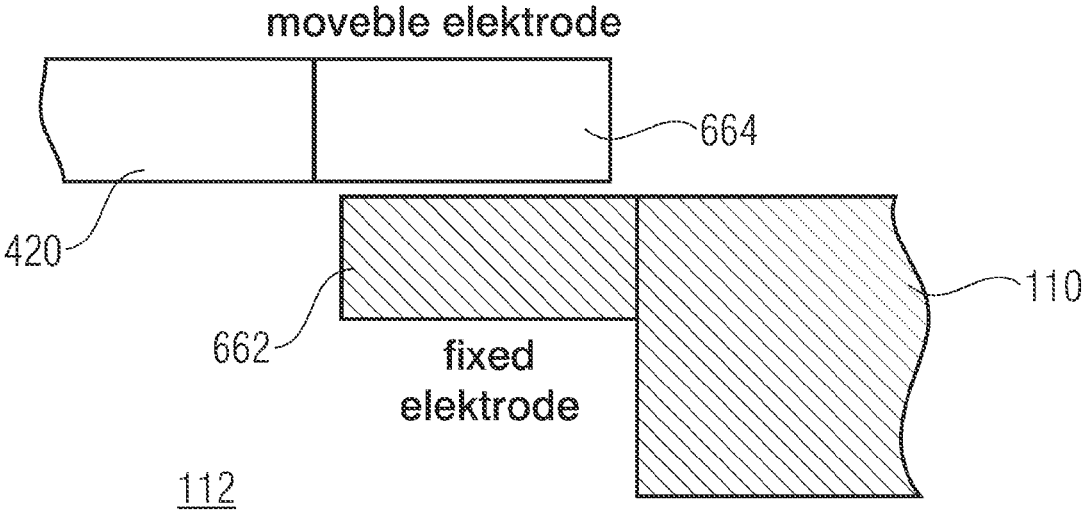
FIG. 7B shows the detail depicted in FIG. 7A in an actuated state.

FIG. 7B shows the detail depicted in FIG. 7A in an actuated state in which the second finger 664 is displaced in a direction away from the cavity 112.

Figure 8A:
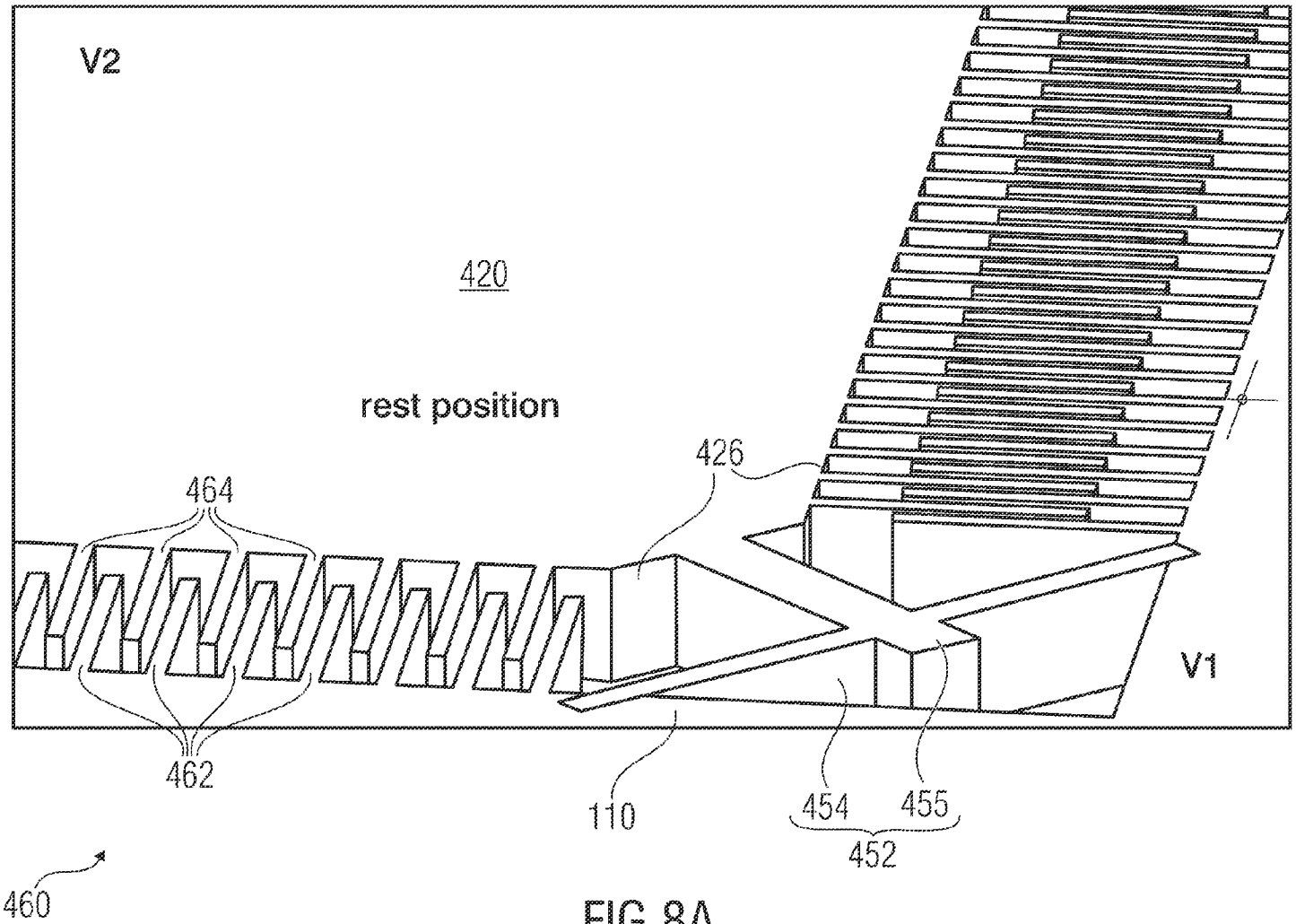
FIG. 8A shows a schematic perspective view of a detail of a sound transducer according to embodiments of the teachings disclosed herein at a rest position.
Figure 8B:
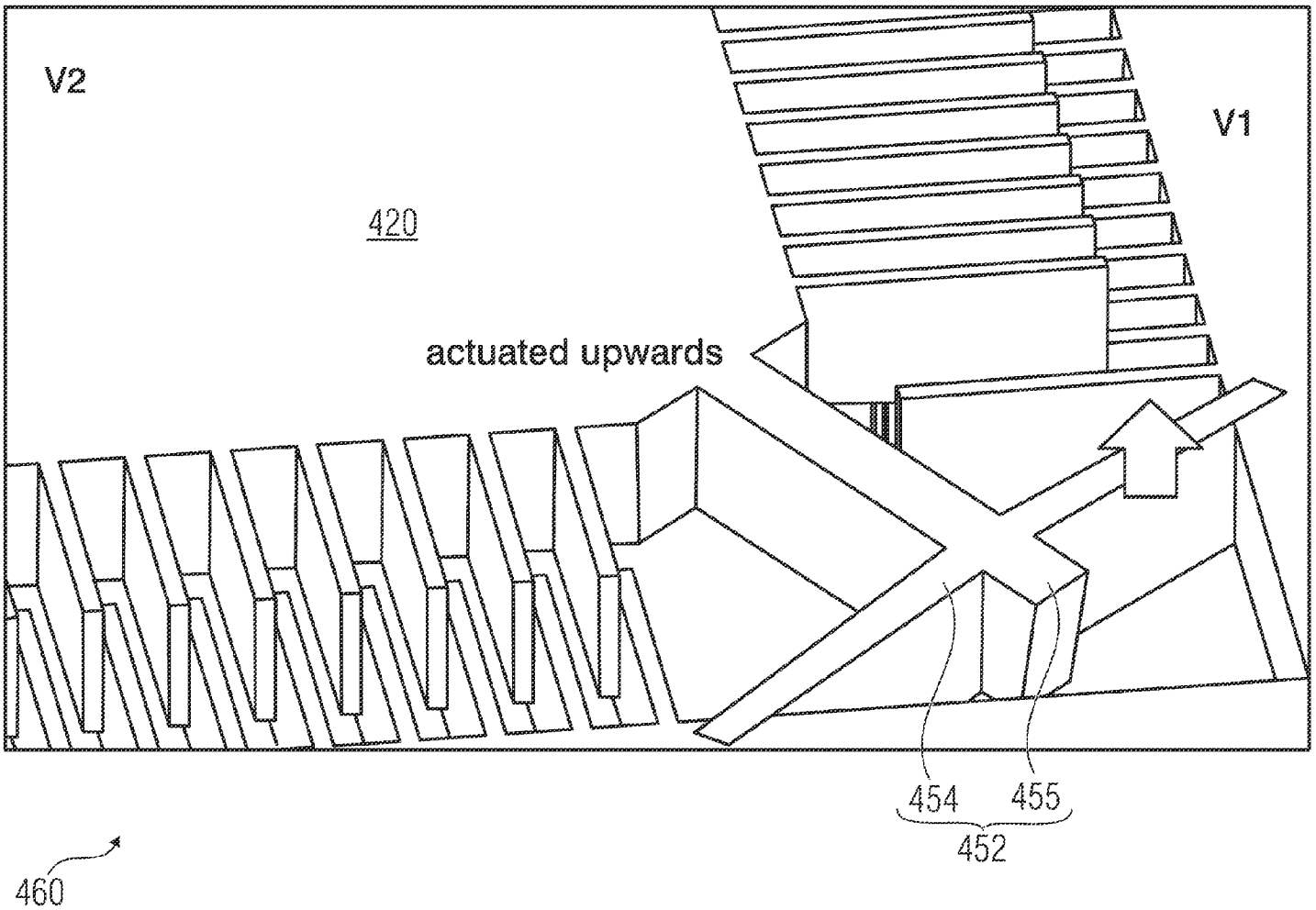
FIG. 8B shows the detail depicted in FIG. 8A in an actuated state.

FIG. 8A shows a schematic perspective view of a detail of a sound transducer according to embodiments of the teachings disclosed herein at a rest position and FIG. 8B shows the same detail in an actuated state. An electrical potential V1 is applied to the substrate 110 and an electrical potential V2 is applied to the membrane 420. When the sound transducer is in the rest position as depicted in FIG. 8A, the first and second electrical potentials V1 and V2 are of opposite sign. Therefore, an attractive electrostatic force is created between the first and second sets of comb fingers 462, 464 of the comb drive 460, which pulls the membrane 420 to the rest position. In the alternative, the first and second sets of comb fingers are substantially free of electrical charge so that no significant electrostatic force is created. FIG. 8B shows the sound transducer when it is actuated upwards.

Figure 9:
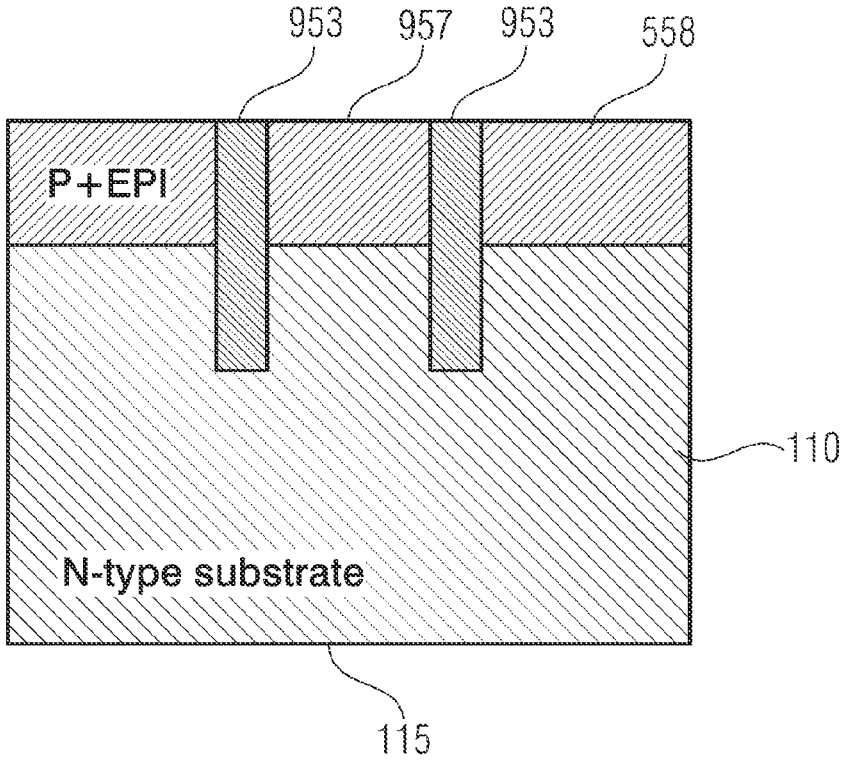
FIG. 9 schematically illustrates a first option for electrical isolation.

FIG. 9 schematically illustrates a first option for electrical isolation of the anchors 558 against the substrate 110, as well as for other isolating tasks. Part of the bulk Si volume 110 is electrically isolated via a p-n junction and deep isolation trenches 953. The substrate 110 is n-doped whereas an epitaxial layer "P+EPI" arranged on a surface of the substrate is p-doped. At the interface, a p-n junction is formed which is blocking when the n-type substrate is at a higher electrical potential than the p-type layer. FIG. 9 also shows a first electrical connection 957 and the anchor 558. The first electrical connection 957 is used to electrically connect the first set of comb fingers 362, 462 with a control signal generator for the comb drive 360, 460. The anchor 558 acts as a second electrical connection for the second set of comb fingers 364, 464. The first electrical connection 957 is electrically isolated from the anchor 558 by means of the trenches 953. The trenches 953 do not have to extend all the way down to the second surface 115 of the surface, as the first electrical connection 957 is also separated from the anchor 558 by means of two p-n junctions having opposite directions. Accordingly, at least one of the two p-n junctions is typically in a blocking state.

Figure 10:
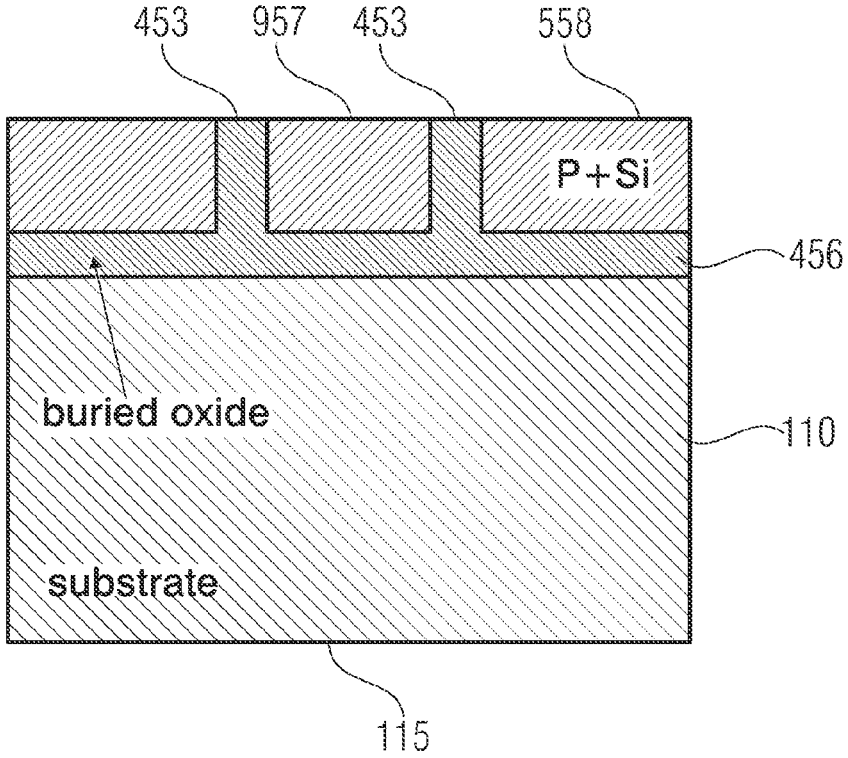
FIG. 10 schematically illustrates a second option for electrical isolation.

FIG. 10 schematically illustrates a second option for electrical isolation in which a buried oxide isolation layer 456 is used. In this configuration, the isolation trenches 453 extend to the buried oxide isolation layer 456 so that the first electrical connection 957 is electrically isolated from the anchor 558.

In an alternative process, the isolation of the static combs 362, 462 with respect to movable combs 364, 464 can be given by an insulating dielectric layer 456 that at the same time acts as the supporting flexure of the actuator. In this case the height of the actuator is not limiting the design of the supporting flexure. It can be designed in lateral manner such as a meander type or vertically with corrugation.

Figure 11:
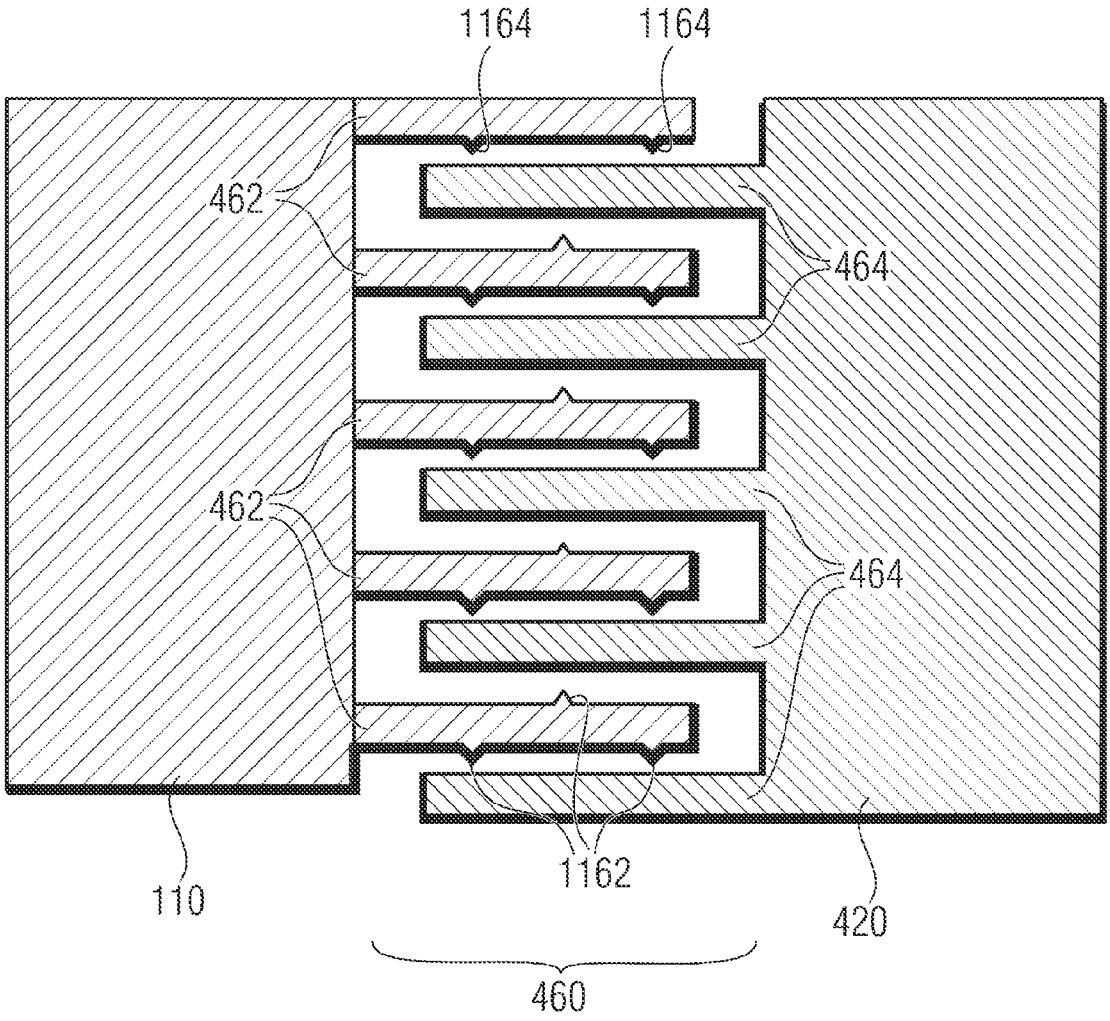
FIG. 11 shows a schematic top view of a detail of a sound transducer according to embodiments of the teachings disclosed herein.

FIG. 11 shows a schematic top view of a detail of a sound transducer according to embodiments of the teachings disclosed herein. The first set of comb fingers 462 comprises anti-stiction structures 1162. In alternative embodiments, anti-stiction structures 1164 and/or 1162 may be arranged at the second set of comb fingers 464 or at both the first and second sets of comb fingers 462, 464. The anti-stiction structure 1162 is configured to prevent a stiction of the interdigitated comb fingers 462, 464. Stiction of the interdigitated comb fingers may be a severe issue in production and use. An easy layout trick to prevent such events from happening is to design sharp structures along the comb that reduce contact force when sticking to a corresponding side of the facing comb finger.

Figure 12:
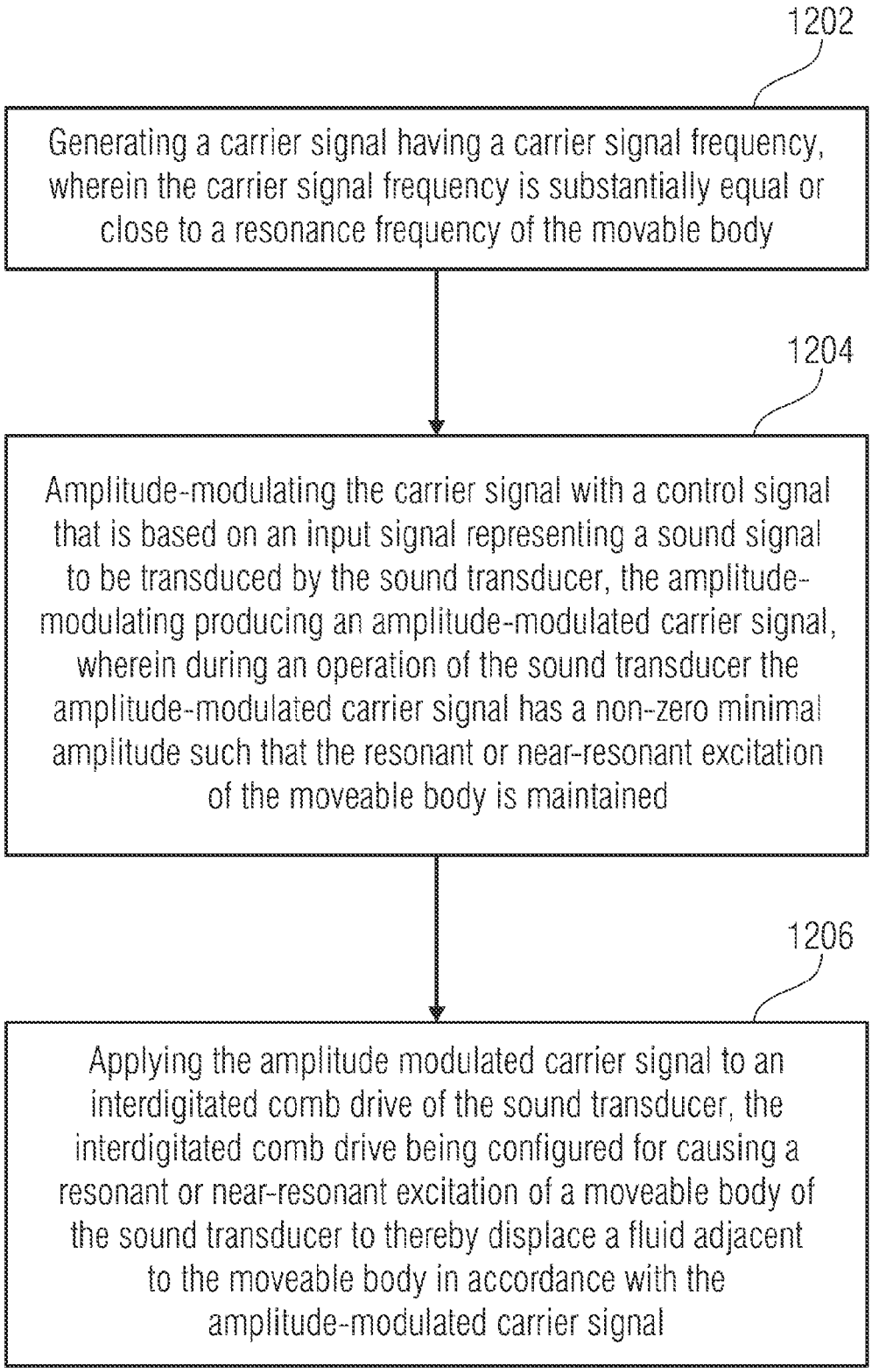
FIG. 12 shows a schematic flow diagram of a method for operating a sound transducer according to an embodiment of the teachings disclosed herein.

FIG. 12 shows a schematic flow diagram of a method for operating a sound transducer according to an embodiment of the teachings disclosed herein. At a step 1202, a carrier signal having a carrier signal frequency is generated. The carrier signal frequency is substantially equal or at least close to a resonance frequency of the movable body of a sound transducer. The resonance frequency of the movable body is determined by the properties of an oscillating or resonating system comprising the body and one or more resilient hinges that connect the movable body to a substrate. At a step 1204, the carrier signal is amplitude-modulated with a control signal that is based on an input signal representing a sound signal to be reproduced by the sound transducer. The amplitude-modulating produces an amplitude-modulated (AM) carrier signal. During an operation of the sound transducer the amplitude-modulated carrier signal has a non-zero minimal amplitude (except for the usual zero-crossings) such that the resonant or near-resonant excitation of the moveable body is maintained. The non-zero minimal amplitude means that even when the control signal decreases to zero, the amplitude-modulated signal continues to oscillate with the non-zero minimal amplitude (i.e., the peaks of the oscillations have the non-zero minimal amplitude). This may be achieved by using a modulation index h<100%. Maintaining the resonant or near-resonant excitation of the moveable body prevents that the movable body gets stuck at the rest position where the moveable body cannot be easily accelerated (dead center), as the components of the electrostatic force mainly act in the direction perpendicular to the movement direction at the rest position.

At a step 1206 the amplitude modulated carrier signal is applied to an interdigitated comb drive of the sound transducer. The interdigitated comb drive is configured for causing a resonant or near-resonant excitation of the moveable body of the sound transducer to thereby displace a fluid adjacent to the moveable body in accordance with the amplitude-modulated carrier signal. This produces a sound signal which is transmitted to a listener. The ear of the listener typically cannot follow the rapid oscillations that are due to the carrier signal. A natural low-pass filtering occurs in the ear of the listener so that the listener is capable of extracting and hearing the input signal (or a signal similar to the input signal).

The amplitude-modulated carrier signal may be DC-biased. In this manner, the desire to maintain the non-zero minimal amplitude is achieved for almost all waveforms of the control signal (a rare exception would be if the control signal is a DC signal having an amplitude that is the additive inverse of the DC-biasing). DC-biased AC voltage may be applied to the electrodes 464 attached to the membrane, while the other set of electrodes 462 and the bulk substrate 110 are grounded.

The control signal may be a digital control signal having at least a low signal value and a high signal value such that the amplitude-modulated carrier signal has a small, non-zero amplitude when being amplitude-modulated with the low signal value and a high amplitude when being amplitude-modulated with the high signal value.

The method may further comprise comparing the input signal with a threshold and setting the control signal to a high signal value if the input signal is above the threshold and setting the control signal to a low, non-zero signal value if the input signal is smaller than the threshold. In an array of sound transducers different sound transducers may have different thresholds such that for a specific input signal value a specific number of the sound transducers are driven by the low, non-zero amplitude-modulated carrier signal and a remaining number of the sound transducers are driven by the high amplitude-modulated carrier signal. As the input signal increases in amplitude, more and more sound transducers may be driven by the high amplitude-modulated carrier signal.

Figure 13:
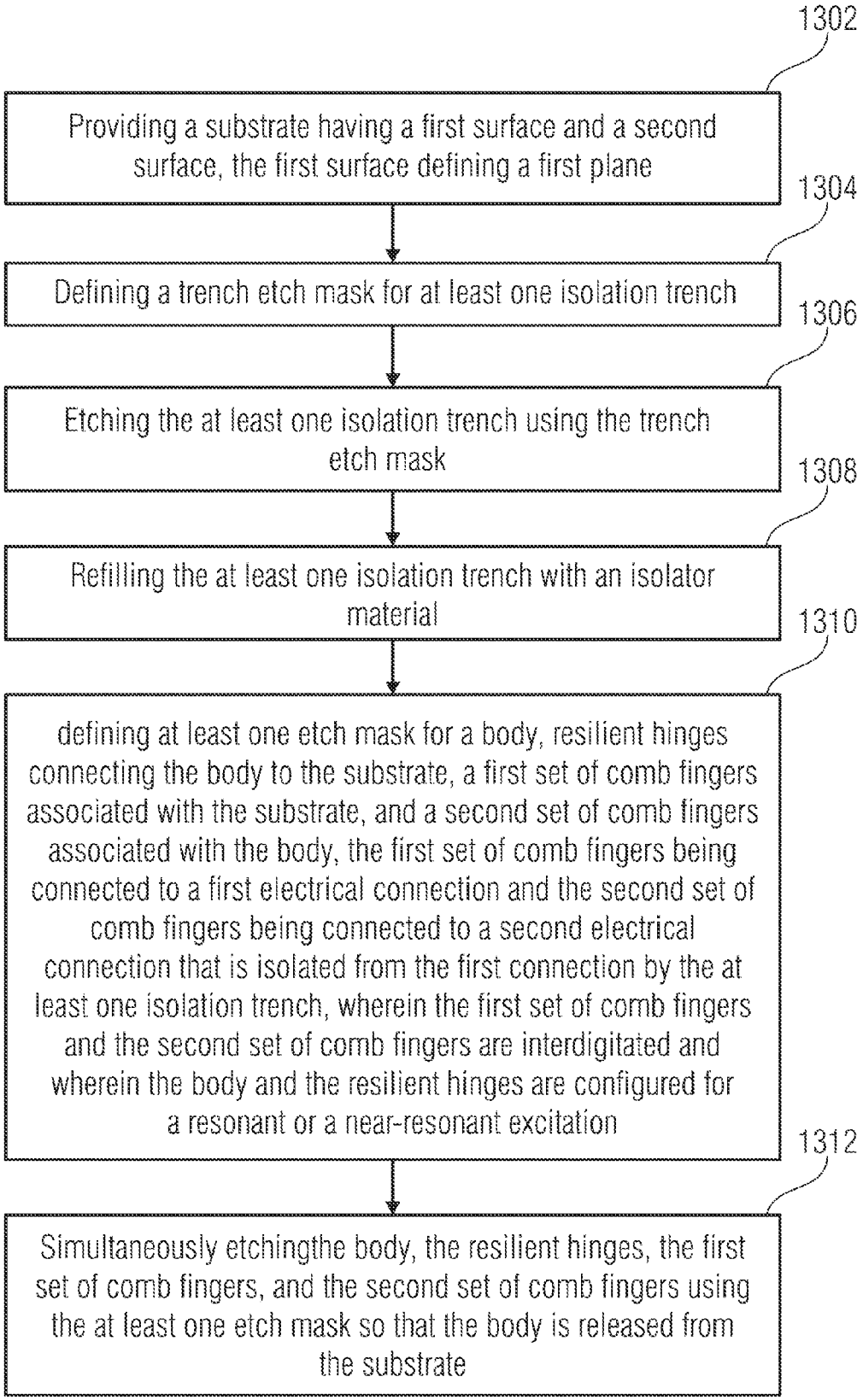
FIG. 13 shows a schematic flow diagram of a method for manufacturing a sound transducer according to an embodiment of the teachings disclosed herein.

FIG. 13 shows a schematic flow diagram of a method for manufacturing a sound transducer according to an embodiment of the teachings disclosed herein. At a step 1302, a substrate is provided which has a first surface and a second surface. The first surface defines a first plane. At a step 1304, a trench etch mask for at least one isolation trench is defined. At a step 1306, the at least one isolation trench is etched using the trench etch mask. At a step 1308, the at least one isolation trench is refilled with an isolator material.

At a step 1310, at least one etch mask for a body, resilient hinges, a first set of comb fingers, and a second set of comb fingers is defined. The resilient hinges will eventually connect the body to the substrate in the completed/manufactured sound transducer. The first set of comb fingers is associated with the substrate and will eventually be connected to a first electrical connection in the completed sound transducer. The second set of comb fingers is associated with the body and will eventually be connected to a second electrical connection that is isolated from the first connection by the at least one isolation trench. The first set of comb fingers and the second set of comb fingers are interdigitated. In the manufactured sound transducer, the body and the resilient hinges are configured for a resonant or a near-resonant excitation.

At a step 1312, the body, the resilient hinges, the first set of comb fingers, and the second set of comb fingers are simultaneously etched using the at least one etch mask so that the body is substantially released from the substrate and only connected to the substrate via the hinges.

The at least one isolation trench may delimit a hinge connection region, such as an anchor 558, of the substrate 110 at which at least one of the at least one resilient hinge 452 is connected. Hence, the isolation trench electrically isolates the hinge connection region from the substrate 110.

During the course of the method for manufacturing the sound transducer, the step of providing the substrate may comprise a formation of an isolating layer 456 within the substrate parallel to the first surface 114. The isolating layer 456 may serve as a bottom isolation for substrate regions that are laterally isolated by the at least one isolation trench 453, 653.

The method may further comprise a backside etch step prior or subsequent to the step of simultaneously etching the body, the at least one resilient hinge, the first set of comb fingers, and the second set of comb fingers. The backside etch produces a cavity 112 for the body, the first set of comb fingers 362, 462 and the second set of comb fingers 364, 464.

FIGS. 14A to 14H illustrate an embodiment of the method for manufacturing a sound transducer according to the teachings disclosed herein.

Figure 14A:
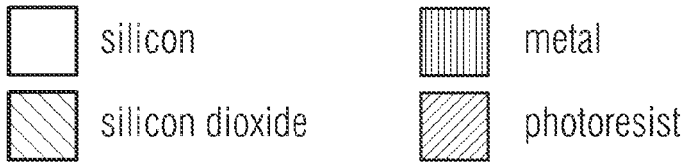
FIG. 14A shows a legend for the following FIGS. 14B to 14H.

FIG. 14A shows a legend for the following FIGS. 14B to 14H to indicate the various materials. FIGS. 14B to 14H shows schematic cross sections to illustrate various stages of a method for manufacturing a sound transducer according to the teachings disclosed herein.

Figure 14B:
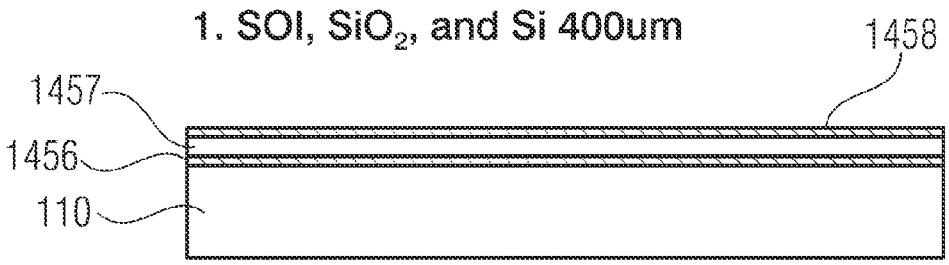
FIGS. 14B to 14H illustrate various stages of a method for manufacturing a sound transducer according to the teachings disclosed herein.

In FIG. 14B a silicon substrate 110 is provided. Furthermore, a silicon dioxide layer 1456 is arranged on a first main surface of the substrate 110. Another silicon layer 1457 is arranged on the silicon oxide layer 1456. In this manner, a silicon-on-insulator (SOI) structure is formed. Another silicon oxide layer 1458 is arranged on the silicon layer 1457. The bulk silicon substrate 110 may be, for example, 400 μm thick. It should be noted that the term "substrate" and the reference numeral 110 may refer not only to the bulk silicon, but also to the multi-layer structure shown in FIG. 14B.

Figure 14C:
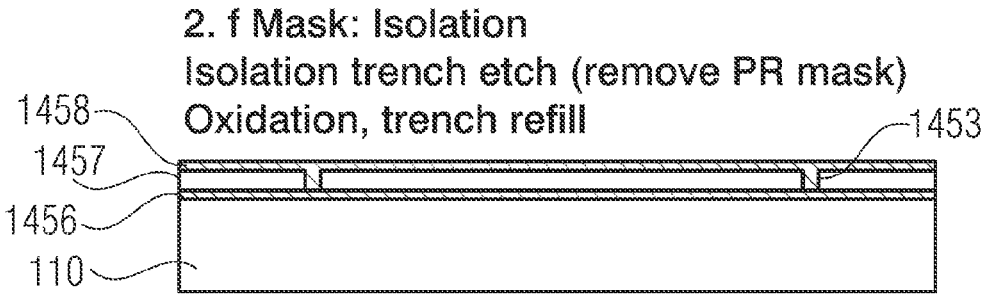

In FIG. 14C, a front mask has been used to define isolation structures, in particular lateral isolation structures, of the future sound transducer. Accordingly, one or more isolation trenches 1453 are formed using the front mask. Subsequently, the photo-resist (PR) mask is removed, an oxidation is performed and the one or more trenches are refilled. FIG. 14B shows the isolation trenches refilled with silicon dioxide.

Figure 14D:
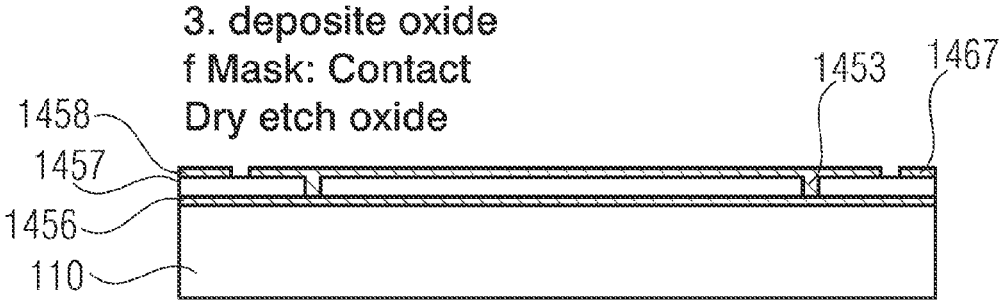

FIG. 14D shows the sound transducer after a further layer of oxide has been deposited and a further front mask has been used to define one or more preliminary cavities 1467 for future contact zones. Furthermore, the oxide was dry-etched.

Figure 14E:
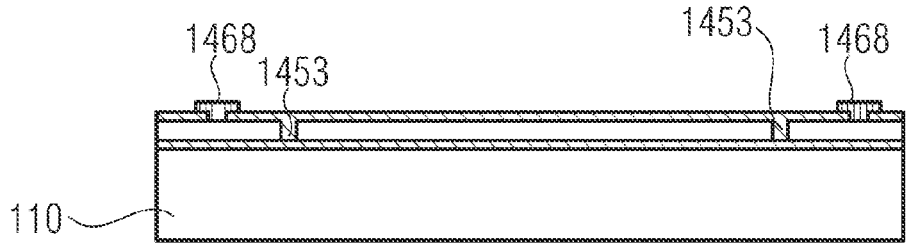

FIG. 14E shows a stage of the manufacturing process at which the contact zones 1468 have been formed using a metal-sputtering process. The contact zones 1468 fill the preliminary cavities 1467. Another front mask is used to structure the contact zones (or "pads") 1468. The pads 1468 are then dry-etched using the front mask. The contact zones 1468 may eventually serve as the first electrical connection and/or the second electrical connection.

Figure 14F:
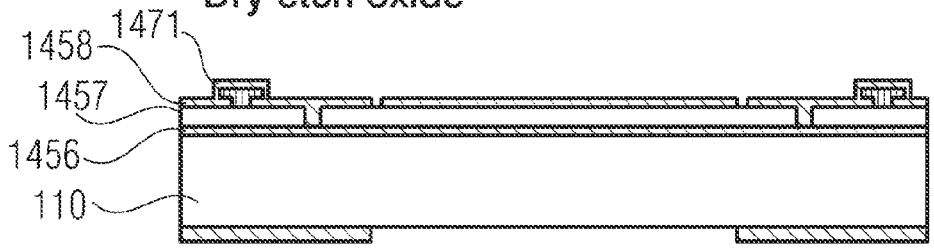

In FIG. 14F, a further silicon dioxide layer 1471 has been deposited on the pads and the already existing dioxide layer 1458. By means of a front mask and a dry-etching of the oxide, the fingers of the interdigitated comb drive are structured in the silicon layer 1457.

Figure 14G:
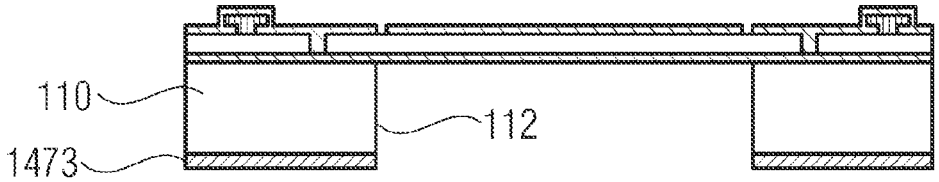

In FIG. 14G, a backside mask 1473 and a dry-etching step have been used to structure a backside trench 112.

Figure 14H:
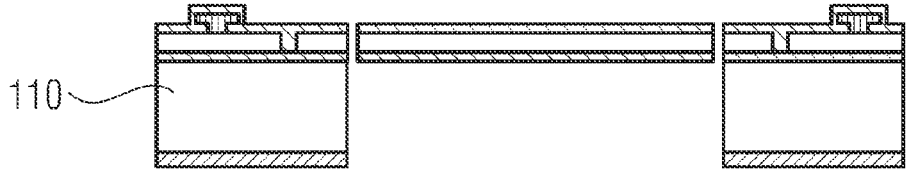

FIG. 14H shows the result after a dry-etching step from the frontside and a wet etching step acting on selected portions of the oxide have been performed.

Figure 15:
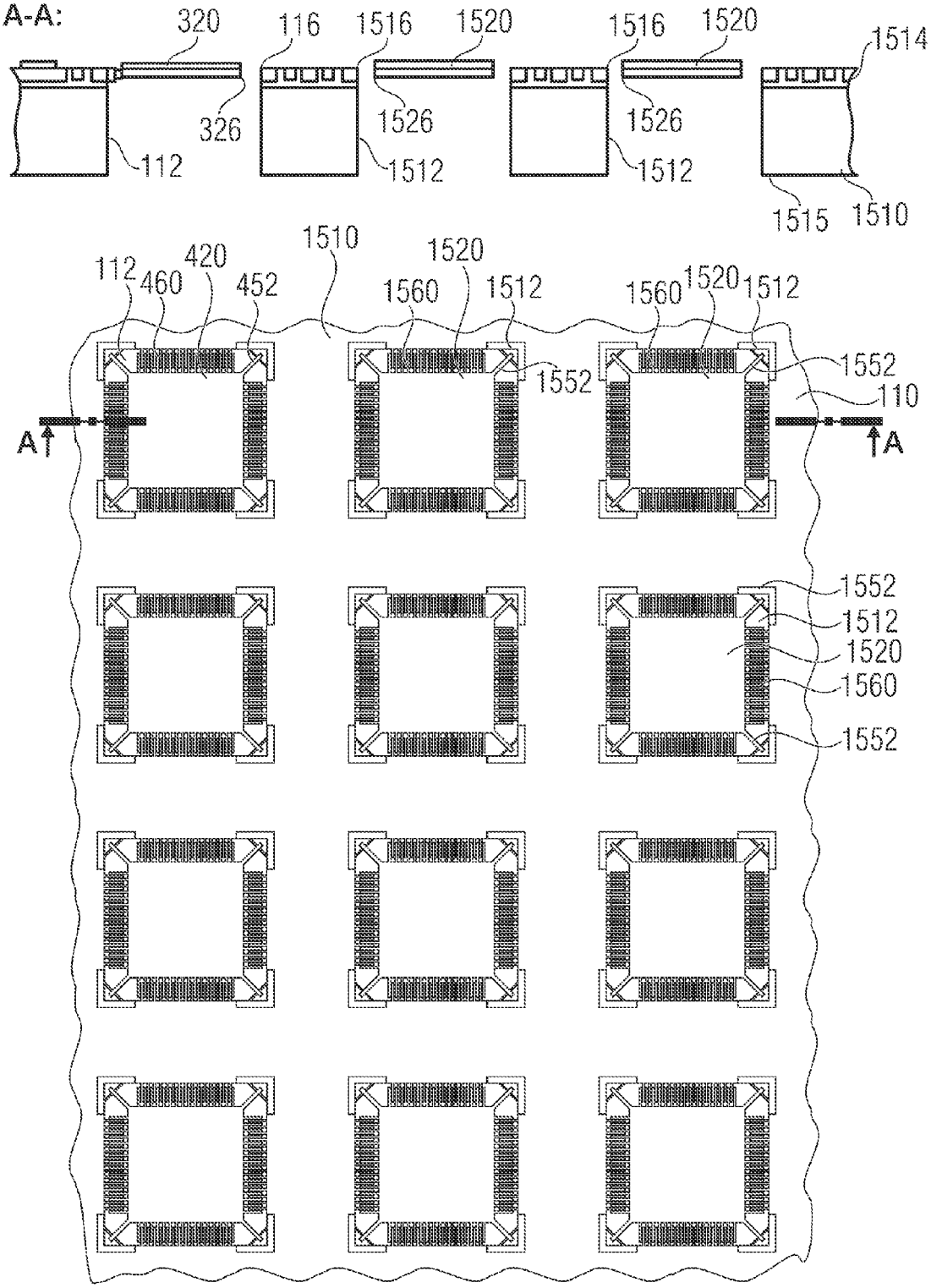
FIG. 15 shows a schematic cross section and a top view of an array of sound transducers according to an embodiment of the teachings disclosed herein.

FIG. 15 shows a schematic cross section and a schematic top view of an array of sound transducers according to an embodiment of the teachings disclosed herein. For example, the array illustrated in FIG. 15 may be a near-resonance piston-type micro speaker array with interdigitated electrostatic actuators (i.e., the sound transducers). The substrate 1510 may have a further cavity 1512 with a further interior peripheral edge 1516, the further cavity 1512 extending between the first surface and the second surface. The array of sound transducers further comprises a further body 1520 having a further exterior peripheral edge 1526, the further body 1520 being parallel to the first plane and at least partially blocking the further cavity 1512. The further body 1520 is connected to the substrate 110 by further resilient hinges 1552. The cavity 112 and the body 420 form a first sound transducing device and the further cavity 1512 and the further body 1520 form a second sound transducing device. In the configuration of FIG. 15, eleven further sound transducing devices are illustrated. The first and second sound transducing device may be interconnected with a polysilicon routing, a metal routing, a routing made from another electrically conducting material, or a combination of these. In particular, the membranes of two or more sound transducing devices may be interconnected. In addition or in the alternative, the substrate-side sets of comb fingers of two or more sound transducing devices may be interconnected. The first and second sound transducing device may be electrically isolated by deep trenches (not shown in FIG. 15) in the substrate 110. In other words, multiple devices may be interconnected with polysilicon or metal routing and/or isolated with deep silicon trenches, which are refilled with dielectric materials such as $SiO_2$, $Si_3N_4$, polymer, or a combination of the above materials.

Thus, each sound transducer comprises a body 420, 1520 having an exterior peripheral edge 426, 1526. The body 420, 1520 is parallel to the first plane and at least partially blocking one of a plurality of cavities 112, 1512 in the substrate 110. The cavity 112, 1512 has an interior peripheral edge 116, 1516 and the body 420, 1520 is connected to the substrate 110 by at least one resilient hinge 452, 1552. In the configuration illustrated in FIG. 15, each body 420, 1520 is connected to the substrate 110 by four resilient hinges 452, 1552. The in-plane comb drive 460, 1560 comprises a first set of comb fingers mounted to the substrate and a second set of comb fingers. The first set of comb fingers is connected to a first electrical connection (not shown). The second set of comb fingers is mounted to the body 420, 1520 and extends past the exterior peripheral edge 426, 1526 of the body. The second set of comb fingers is connected to a second electrical connection that is isolated from the first electrical connection. The first set of comb fingers and the second set of comb fingers of the comb drive 460, 1560 are interdigitated such that as the body 420, 1520 moves, the first set of comb fingers and the second set of comb fingers maintain a relative spacing (in a direction substantially perpendicular to the direction of movement). The first set of comb fingers and the second set of comb fingers are configured to create an electrostatic driving force in a direction perpendicular to the first plane. The body 420, 1520 and the at least one resilient hinge 452, 1552 are configured for a resonant or near-resonant excitation by the electrostatic force. The sound transducers are individually or group-wise controllable in a digital manner such that an overall sound signal of the array of sound transducers is composed from individual sound signals produced by the individually controlled sound transducers.

With the array shown in FIG. 15, the devices can be grouped or individually accessed via interconnection wiring and produce a high frequency acoustic wave, which can then be modulated with other frequencies within human hearing range of different amplitudes. In the alternative, one or more digital control signals may be used to modulate the high frequency acoustic waves generated by the various sound transducing elements.

Figure 16:
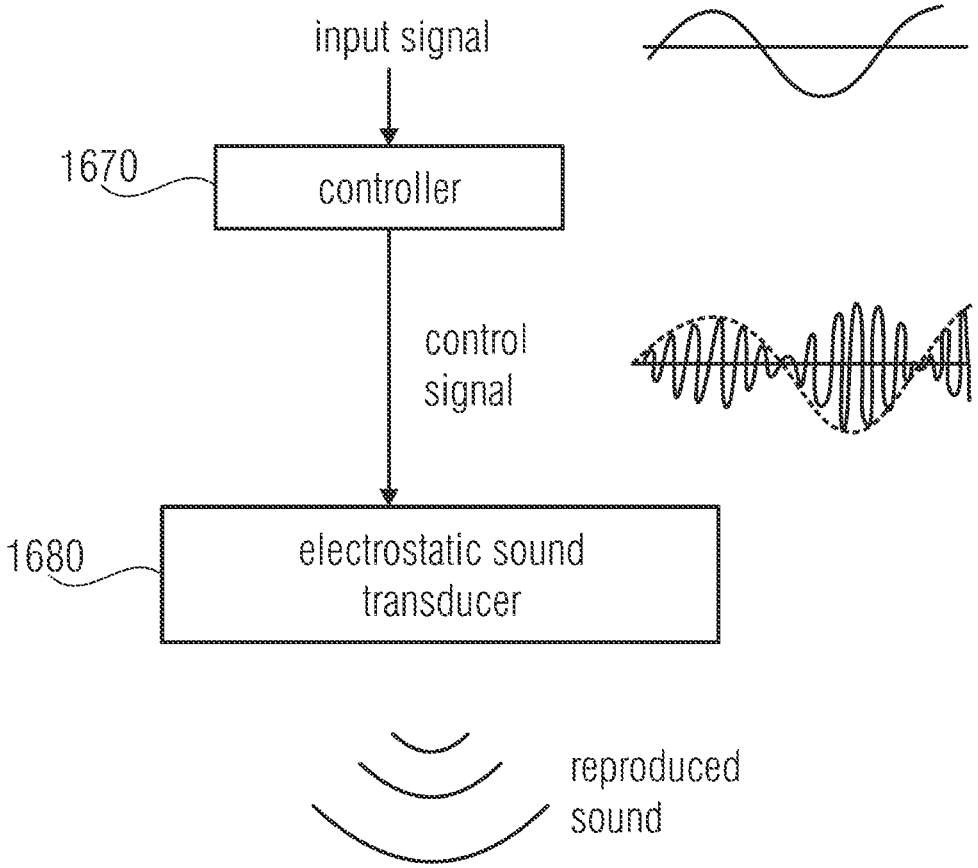
FIG. 16 shows a schematic block diagram of a sound reproduction system according to an embodiment of the teachings disclosed herein.

FIG. 16 shows a schematic block diagram of a sound reproduction system according to an embodiment of the teachings disclosed herein. The sound reproduction system comprises a controller 1670 and an electrostatic sound transducer 1680. The controller 1670 receives an input signal which represents a waveform of a sound signal to be reproduced by the sound reproduction system. The controller 1670 is configured to process the input signal and to generate a control signal for the electrostatic sound transducer 1680. The control signal is an amplitude-modulated signal obtained by amplitude-modulating a carrier signal having a relatively high carrier signal frequency with the input signal. The carrier signal frequency is equal to a resonance frequency of the electrostatic sound transducer 1680, or at least relatively close to the resonance frequency. Thus, the electrostatic sound transducer responds well to the excitation of the control signal. A membrane of the electrostatic sound transducer 1680 is thus capable of performing relatively wide oscillations, as it may be expected for the resonance case. Therefore, the electrostatic sound transducer 1680 may quickly follow a change of the peak amplitude of the oscillations of the control signal, so that an envelope of the control signal is a function of the input signal. Note that a frequency doubling occurs between the input signal and the envelope of the control signal. The reproduced sound output by the electrostatic transducer 1680 is "decoded" by a listener due to a natural low-pass filter characteristic of the human ear.

Figure 17:
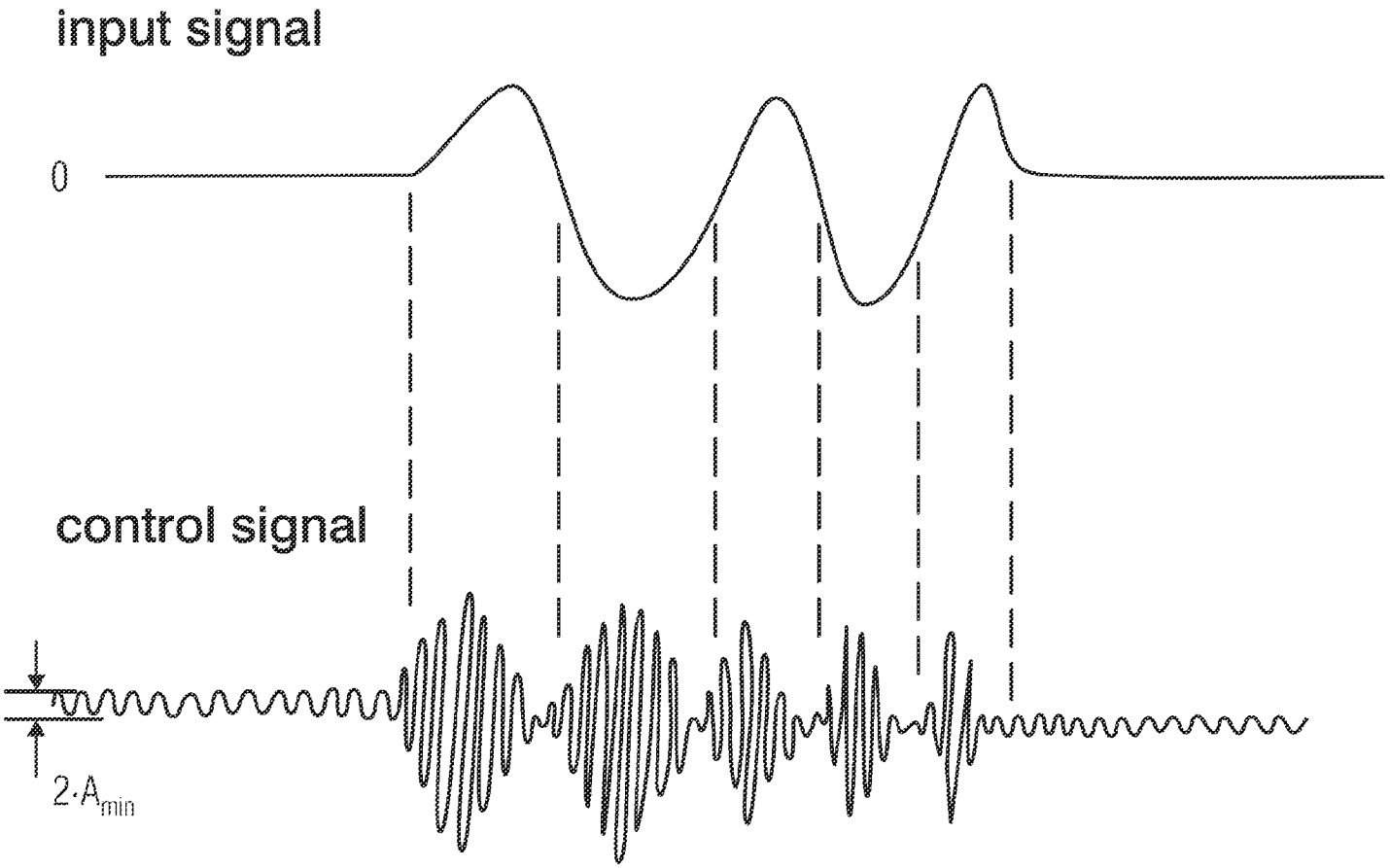
FIG. 17 illustrates two signals that are processed by the sound reproduction system of FIG. 16 for an analog sound reproduction.

FIG. 17 schematically illustrates two signals that are processed by the sound reproduction system of FIG. 16 for an analog sound reproduction. The input signal is an audio signal in the hearing frequency range, e.g., from approximately 40 Hz to 16 kHz. The control signal is an amplitude-modulated signal obtained by modulating a carrier signal with the input signal. Note that even when the input signal is zero within a certain time interval, the control signal still performs oscillations at a minimum amplitude $A_{min}$ (peak-to-peak amplitude is $2A_{min}$). This minimum amplitude oscillation keeps the membrane of the electrostatic sound transducer in motion so that the membrane does not get stuck at a dead center of the oscillation. The sound produced by the minimum amplitude oscillation is typically not perceivably, as it the corresponding sound pressure level is very low and the frequency is beyond the hearing range of the human ear, anyway.

Figure 18:
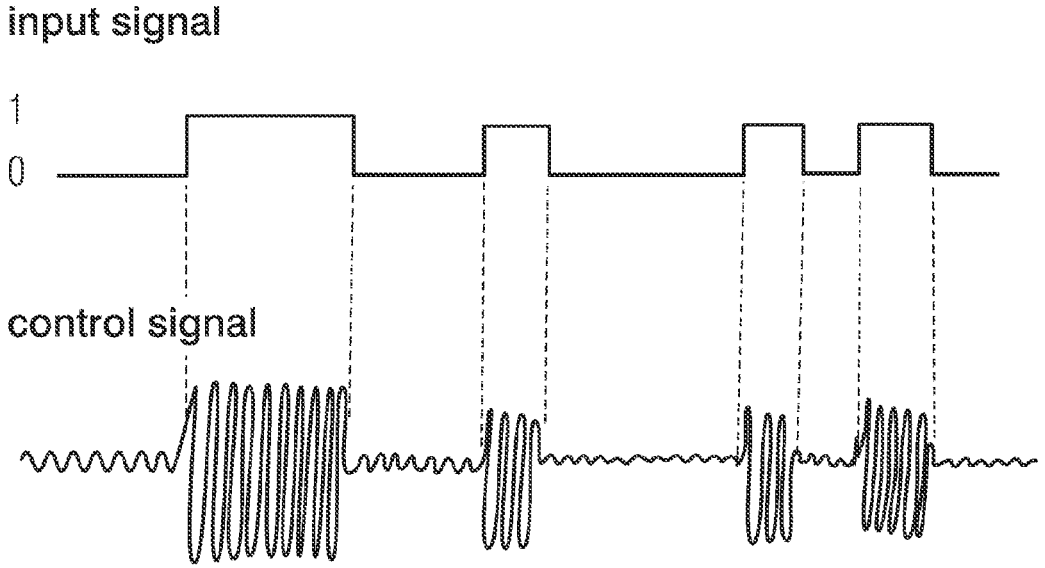
FIG. 18 illustrates two signals that are processed by the sound reproduction system of FIG. 16 for a digital sound reproduction.

FIG. 18 illustrates two signals that are processed by the sound reproduction system of FIG. 16 for a digital sound reproduction. The input signal may be intended for a single sound transducing device of an array of sound transducers, or for a group of sound transducing devices of the array of sound transducers. The input signal is digital and may assume two values. A first value is a logical "0" and a second value is a logical "1". When the input signal has the value "0", the control signal performs minimum amplitude oscillations. When the input signal has the value "1", the control signal performs relatively large oscillations at the resonance frequency of the resonating system of the electrostatic sound transducer. As the sound transducer is operated at resonance frequency, it may perform post-pulse oscillation or "ringing" after the control signal has made a transition from the large amplitude oscillations to the minimum amplitude oscillations. By adjusting (increasing) the damping of the resonating system of the electrostatic sound transducer, such ringing may be notably reduced. As an alternative, the ringing of the membrane may be taken into account and even used to advantage when generating the digital input signal. In particular, the falling edges within the digital control signal may be advanced ("anticipated") by a specific time interval so that the ringing occurs during a time that coincides with a final phase of a high-amplitude time interval.

Figure 19:
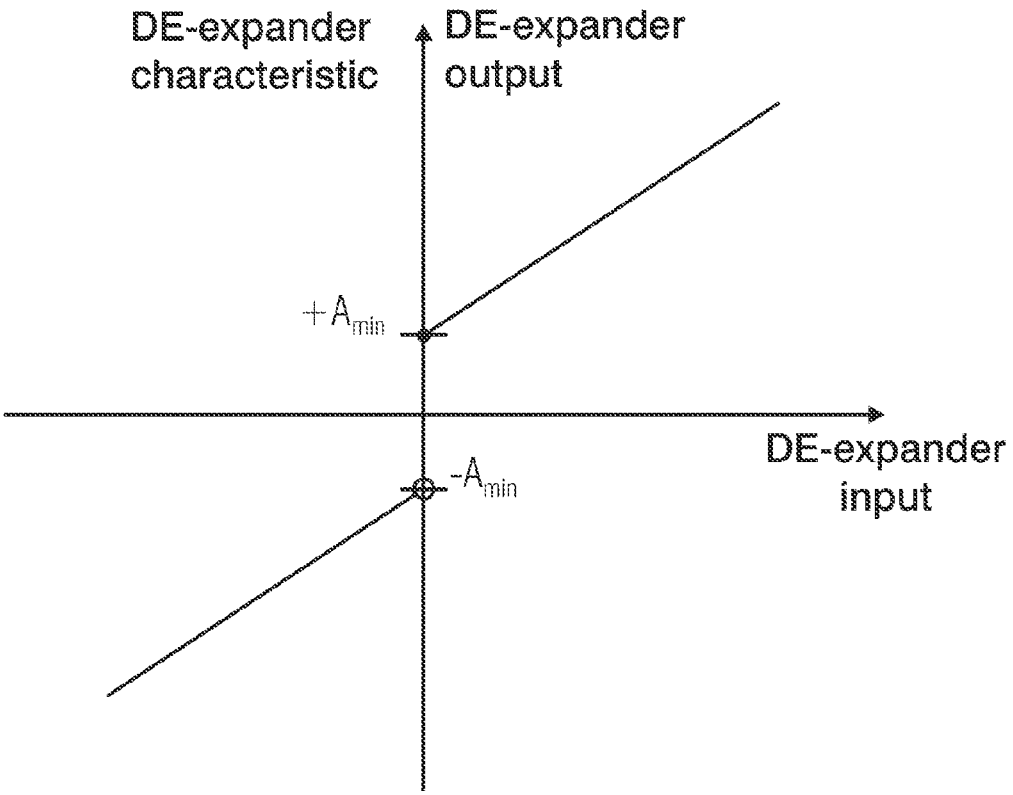
FIG. 19 illustrates an input/output characteristic of a de-expander that may be used in the sound reproduction system of FIG. 16.

FIG. 19 illustrates an input/output characteristic of a de-expander that may be used in the sound reproduction system of FIG. 16. The de-expander is a non-linear filter that adds the minimum amplitude $A_{min}$ to the magnitude of the input signal. The de-expander may process the input signal of FIG. 17 or 18 prior to the amplitude-modulation. Due to the minimum amplitude, the amplitude-modulated signal maintains at least a small oscillation even when the input signal is substantially zero, in order to keep the membrane in resonant motion. At an initial start up of the electrostatic transducer, a small asymmetry is typically sufficient for the resonant mode excitation to build up a permanent oscillation within a certain number of oscillations, such as within ten oscillations, 20 oscillations, or 100 oscillations.

Figure 20A:
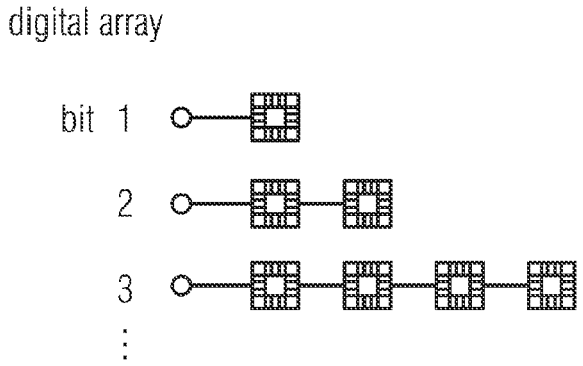
FIGS. 20A to 20C illustrate an option for digital sound reconstruction using an array of sound transducers.
Figure 20B:
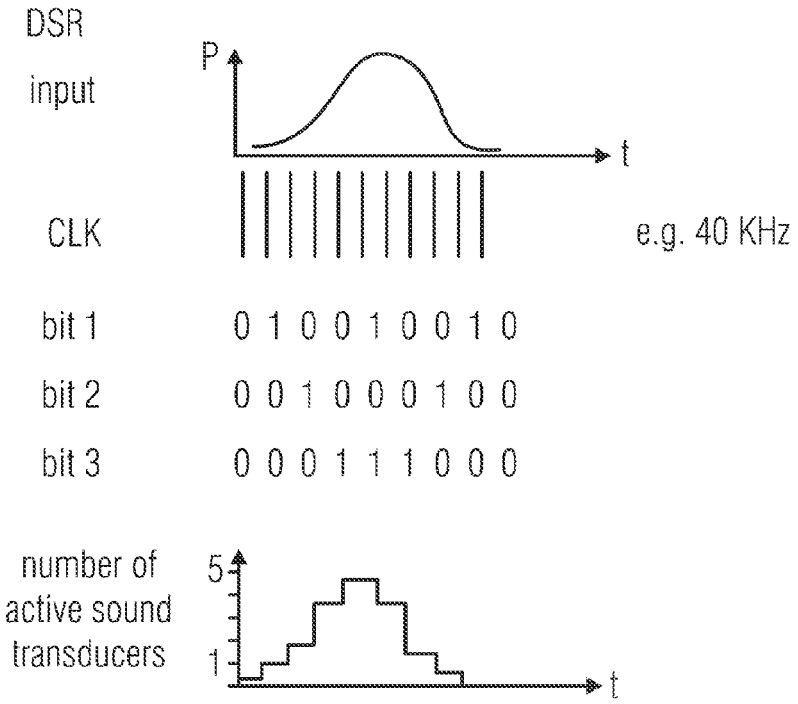
Figure 20C:
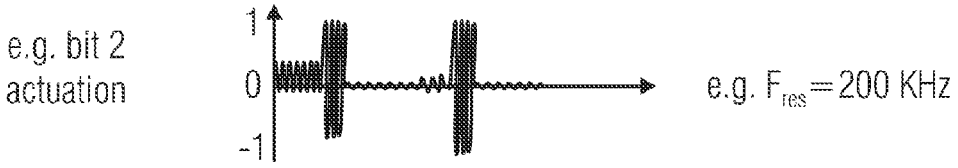

FIGS. 20A to 20C illustrate one possible scheme for digital sound reconstruction using an array of sound transducers. FIG. 20A illustrates which sound transducers are actuated for a given bit. Hence, a single sound transducer is actuated when bit 1 is active. Two (different) sound transducers are actuated when bit 2 is active and four further sound transducers are activated when bit 3 is active.

FIG. 20B illustrates how an input signal (represented by its instantaneous power) is digitally represented by the three bits 1 to 3. To this end, the input signal is sampled with a sample rate of, for example, 40 kHz. The sample rate is provided by a clock (CLK). The number of active sound transducers over time is graphically illustrated in the lower part of FIG. 20B. By superposing the sound signals produced by the individual sound transducers, an overall sound signal of the array is generated which reproduces the input signal.

FIG. 20C illustrates a control signal for the sound transducers that are assigned to bit 2. The sound transducers are driven with a signal having a carrier frequency of, e.g., 200 kHz. When bit 2 is low, the control signal has only a small amplitude (e.g., $A_{min}$ mentioned above in the context of FIGS. 17 and 19). When bit 2 is high, the control signal has a relatively high amplitude.

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus. Some or all of the method steps may be executed by (or using) a hardware apparatus, like, for example, a microprocessor, a programmable computer or an electronic circuit. In some embodiments, some one or more of the most important method steps may be executed by such an apparatus.

The above described embodiments are merely illustrative for the principles of the present invention. It is understood that modifications and variations of the arrangements and the details described herein will be apparent to others skilled in the art. It is the intent, therefore, to be limited only by the scope of the impending patent claims and not by the specific details presented by way of description and explanation of the embodiments herein.

What is claimed is:

1. A sound transducer comprising:

a substrate having a first surface and a second surface, the first surface defining a first plane, the substrate having a cavity with an interior peripheral edge, the cavity extending from the first surface;

a body having an exterior peripheral edge, the body being parallel to the first plane and at least partially covering the cavity, the body being connected to the substrate by at least one resilient hinge;

a first set of comb fingers mounted to the substrate, the first set of comb fingers being connected to a first electrical connection; and a second set of comb fingers mounted to the body and extending past the exterior peripheral edge of the body, the second set of comb fingers being connected to a second electrical connection that is isolated from the first electrical connection, wherein the first set of comb fingers and the second set of comb fingers are interdigitated and configured to create an electrostatic force driving the body in a direction perpendicular to the first plane, wherein the body and the at least one resilient hinge are configured for a resonant or a near-resonant excitation by the electrostatic force, wherein the body and the at least one resilient hinge form a resonating structure, and wherein the first set of comb fingers and the second set of comb fingers are configured to drive the resonating structure, during an operation of the sound transducer, in a substantially permanent resonant or near-resonant excitation and to amplitude-modulate a resulting oscillation of the body at or near a resonant frequency of the resonating structure with a control signal that is based on an electrical input signal to be transduced by the sound transducer.

2. The sound transducer according to claim 1, wherein, at a rest position of the body, the first set of comb fingers and the second set of comb fingers are displaced with respect to each other, and wherein a displacement between the first set of comb fingers and the second set of comb fingers is less or equal to 10% of a maximum amplitude of an operative displacement of the body in the direction perpendicular to the first plane.

3. The sound transducer according to claim 1, wherein, at a rest position of the body, the first set of comb fingers and the second set of comb fingers are offset with respect to each other in the direction perpendicular to the first plane by an offset less or equal to 10% of a maximum amplitude of an operative displacement of the body in the direction perpendicular to the first plane.

4. The sound transducer according to claim 1, wherein the first set of comb fingers and the second set of comb fingers have different extensions in the direction perpendicular to the first plane.

5. The sound transducer according to claim 1, further comprising a film of a material having an intrinsic stress different from an intrinsic stress of a body material and a hinge material, the film being located at or in at least one of the body and the at least one resilient hinge such that, due to an intrinsic stress difference, the first set of comb fingers and the second set of comb fingers are displaced with respect to each other in the direction perpendicular to the first plane.

6. The sound transducer according to claim 1, wherein the body and the at least one resilient hinge are monolithically integrated with the substrate.

7. The sound transducer according to claim 1, wherein the body has a lateral extension parallel to the first plane between 200 μm and 1000 μm, and a thickness in the direction perpendicular to the first plane between 5 μm and 70 μm.

8. The sound transducer according to claim 1, wherein the body and the at least one resilient hinge form a resonating structure having a resonating frequency between 40 kHz and 400 kHz.

9. The sound transducer according to claim 1, further comprising a Helmholtz resonator.

10. A sound transducer comprising:

a substrate having a first surface and a second surface, the first surface defining a first plane, the substrate having a cavity with an interior peripheral edge, the cavity extending from the first surface;

a body having an exterior peripheral edge, the body being parallel to the first plane and at least partially covering the cavity, the body being connected to the substrate by at least one resilient hinge;

a first set of comb fingers mounted to the substrate, the first set of comb fingers being connected to a first electrical connection; and a second set of comb fingers mounted to the body and extending past the exterior peripheral edge of the body, the second set of comb fingers being connected to a second electrical connection that is isolated from the first electrical connection, wherein the first set of comb fingers and the second set of comb fingers are interdigitated and configured to create an electrostatic force driving the body in a direction perpendicular to the first plane, wherein the body and the at least one resilient hinge are configured for a resonant or a near-resonant excitation by the electrostatic force, wherein the first set of comb fingers and the second set of comb fingers form an in-plane comb drive structure, wherein the body and the at least one resilient hinge form a resonating structure, and wherein the first set of comb fingers and the second set of comb fingers are configured to drive the resonating structure, during an operation of the sound transducer, in a substantially permanent resonant or near-resonant excitation and to amplitude-modulate a resulting oscillation of the body at or near a resonant frequency of the resonating structure with a control signal that is based on an electrical input signal to be transduced by the sound transducer.

11. The sound transducer according to claim 1, wherein the substrate has a further cavity with a further interior peripheral edge, the further cavity extending between the first surface and the second surface, and wherein the sound transducer further comprises a further body having a further exterior peripheral edge, the further body being parallel to the first plane and at least partially blocking the further cavity, the further body connected to the substrate by further resilient hinges.

12. The sound transducer according to claim 11, wherein the cavity and the body form a first sound transducing device and the further cavity and the further body form a second sound transducing device, the first and second sound transducing devices being interconnected with a polysilicon routing or a metal routing.

13. The sound transducer according to claim 11, wherein the cavity and the body form a first sound transducing device and the further cavity and the further body form a second sound transducing device, the first and second sound transducing devices being electrically isolated by deep trenches in the substrate.

14. The sound transducer according to claim 1, wherein a part of the substrate is electrically isolated by means of at least one of a pn-junction, a buried oxide isolation layer, or dielectric layer.

15. The sound transducer according to claim 1, further comprising an anti-stiction structure at least at one of the first set of comb fingers and the second set of comb fingers, the anti-stiction structure configured to prevent a stiction of the interdigitated comb fingers.

16. The sound transducer according to claim 1, wherein the first set of comb fingers and the second set of comb fingers maintain a minimum relative spacing as the body moves.

17. An array of sound transducers, the array comprising:

a substrate having a first surface and a second surface, the first surface defining a first plane, wherein each sound transducer comprises a body having an exterior peripheral edge, the body being parallel to the first plane and at least partially blocking one of a plurality of cavities in the substrate, each cavity having an interior peripheral edge and the body being connected to the substrate by at least one resilient hinge;

a first set of comb fingers mounted to the substrate, the first set of comb fingers being connected to a first electrical connection; and a second set of comb fingers mounted to the body and extending past the exterior peripheral edge of the body, the second set of comb fingers being connected to a second electrical connection that is isolated from the first electrical connection, the first set of comb fingers and the second set of comb fingers being interdigitated such that as the body moves, the first set of comb fingers and the second set of comb fingers maintaining a relative spacing, the first set of comb fingers and the second set of comb fingers being configured to create an electrostatic driving force in a direction perpendicular to the first plane, wherein the body and the at least one resilient hinge are configured for a resonant or near-resonant excitation by the electrostatic driving force, and wherein the sound transducers are individually or group-wise controllable in a digital manner such that an overall sound signal of the array of sound transducers is composed from individual sound signals produced by the individually or group-wise controlled sound transducers.

18. The array of sound transducers according to claim 17, wherein each individually controllable sound transducer is configured to operate, during an operation of the array of sound transducers, in at least two operating states, wherein the body of the individually controlled sound transducer is configured to oscillate with a relatively low amplitude at or near a resonance frequency of a resonating structure formed by the body and the at least one resilient hinge in a first operating state, and wherein the body is configured to oscillate with a relatively high amplitude at or near the resonance frequency of the resonating structure during a second operating mode.

19. A resonantly excitable sound transducer comprising:

a substrate having a first surface and a second surface, the first surface defining a first plane, the substrate having a cavity with an interior peripheral edge, the cavity extending from at least one of the first surface and the second surface;

a mechanical resonator structure at least partially blocking the cavity, the mechanical resonator structure comprising a body, the body being connected to the substrate by at least one resilient hinge, wherein the body and the at least one resilient hinge are configured to cause a displacement of a fluid within the cavity substantially at a resonant frequency of the mechanical resonator structure; and an interdigitated comb drive arranged at a gap between the substrate and the mechanical resonator structure configured to create an electrostatic force to cause a resonant or near-resonant excitation of the mechanical resonator structure, wherein the interdigitated comb drive has an in-plane structure, and wherein a first set of comb fingers and a second set of comb fingers are configured to drive the mechanical resonator structure, during an operation of the sound transducer, in a substantially permanent resonant or near-resonant excitation and to amplitude-modulate a resulting oscillation of the mechanical resonator structure at or near a resonant frequency thereof with a control signal that is based on an electrical input signal to be transduced by the sound transducer.

20. The resonantly excitable sound transducer according to claim 19, wherein the substrate and at least a portion of the mechanical resonator structure are monolithically integrated.

21. A sound transducer comprising:

a substrate having a first surface and a second surface, the first surface defining a first plane, the substrate having a cavity with an interior peripheral edge, the cavity extending from the first surface;

a body having an exterior peripheral edge, the body being parallel to the first plane and at least partially covering the cavity, the body being connected to the substrate by at least one resilient hinge;

a first set of comb fingers mounted to the substrate, the first set of comb fingers being connected to a first electrical connection; and a second set of comb fingers mounted to the body and extending past the exterior peripheral edge of the body, the second set of comb fingers being connected to a second electrical connection that is isolated from the first electrical connection, wherein the first set of comb fingers and the second set of comb fingers are interdigitated and configured to create an electrostatic force driving the body in a direction perpendicular to the first plane, wherein the body and the at least one resilient hinge are configured for a resonant or a near-resonant excitation by the electrostatic force, wherein the substrate has a further cavity with a further interior peripheral edge, the further cavity extending between the first surface and the second surface, and wherein the sound transducer further comprises a further body having a further exterior peripheral edge, the further body being parallel to the first plane and at least partially blocking the further cavity, the further body connected to the substrate by further resilient hinges.

22. The sound transducer according to claim 21, wherein the cavity and the body form a first sound transducing device and the further cavity and the further body form a second sound transducing device, the first and second sound transducing devices being interconnected with a polysilicon routing or a metal routing.

23. The sound transducer according to claim 21, wherein the cavity and the body form a first sound transducing device and the further cavity and the further body form a second sound transducing device, the first and second sound transducing devices being electrically isolated by deep trenches in the substrate.

* * * * *